US006183324B1

(12) United States Patent
Nanami

(10) Patent No.: US 6,183,324 B1
(45) Date of Patent: Feb. 6, 2001

(54) EXHAUST SYSTEM FOR ENGINE POWERING A WATERCRAFT

(75) Inventor: Masayoshi Nanami, Iwata (JP)

(73) Assignee: Yamaha Hatsudoki Kabushiki Kaisha, Iwata (JP)

( * ) Notice: Under 35 U.S.C. 154(b), the term of this patent shall be extended for 0 days.

(21) Appl. No.: 09/016,201

(22) Filed: Jan. 30, 1998

Related U.S. Application Data

(63) Continuation-in-part of application No. 08/960,537, filed on Oct. 31, 1996.

(30) Foreign Application Priority Data

Jan. 30, 1997 (JP) ..... 9-016241

(51) Int. Cl.[7] ..... B63H 21/32
(52) U.S. Cl. ..... 440/89
(58) Field of Search ..... 114/55.5; 440/38, 440/89

(56) References Cited

U.S. PATENT DOCUMENTS

| | | | | |
|---|---|---|---|---|
| 4,824,409 | | 4/1989 | Kobayashi . | |
| 4,972,809 | * | 11/1990 | Hirasawa | 123/58 R |
| 4,997,399 | * | 3/1991 | Nakayasu et al. | 440/89 |
| 5,511,505 | * | 4/1996 | Kobayashi et al. | 440/89 |
| 5,524,597 | | 6/1996 | Hiki et al. . | |
| 5,536,189 | | 7/1996 | Mineo . | |
| 5,556,314 | | 9/1996 | Fukuda et al. . | |
| 5,586,921 | * | 12/1996 | Kobayashi et al. | 440/38 |
| 5,636,586 | | 6/1997 | Suganuma . | |
| 5,676,575 | | 10/1997 | Fukuda et al. . | |
| 5,882,236 | * | 3/1999 | Ozawa et al. | 440/89 |

* cited by examiner

*Primary Examiner*—Ed Swinehart
(74) *Attorney, Agent, or Firm*—Knobbe, Martens, Olson & Bear LLP

(57) ABSTRACT

Various embodiments of an exhaust system for an engine powering a water propulsion device of a watercraft having a hull with a front end and a rear end are disclosed. The water propulsion device is positioned near the rear end of the watercraft, with the engine connected to the hull and positioned generally towards the front end of the watercraft from the water propulsion device and having an output shaft arranged to drive the water propulsion device. The exhaust system routes exhaust from each cylinder or combustion chamber of the engine to a discharge at the rear end of the watercraft.

30 Claims, 27 Drawing Sheets

EXHAUST SYSTEM FOR ENGINE POWERING A WATERCRAFT

RELATED APPLICATION DATA

This application is a continuation-in-part of U.S. patent application Ser. No. 08/960,537 filed Oct. 31, 1996.

FIELD OF THE INVENTION

The present invention is an exhaust system for an engine. More particularly, the invention is an exhaust system for an internal combustion engine powering a water propulsion device of a watercraft.

BACKGROUND OF THE INVENTION

Watercraft are often powered by internal combustion engines. This is especially true of the type of watercraft known as personal watercraft.

Personal watercraft have a hull which defines an engine compartment. The engine is mounted in the engine compartment and has its output shaft arranged to drive a water propulsion of the watercraft.

The engine produces exhaust products as a by-product of the combustion of fuel. It is desirable to route this exhaust from the engine to a point external to the watercraft. Generally, an exhaust system is provided for this purpose. The exhaust system normally includes at least one exhaust pipe extending from a port through the engine leading from a cylinder to a discharge point.

Many times, little attention is given the exhaust system, with the result being a detrimental affect on engine and/or watercraft performance. For example, it is generally desirable to arrange the exhaust system so that it occupies a small amount of space. In this manner, the space occupied by the engine is minimized, and the overall size of the watercraft may be minimized lending to a light and maneuverable craft. In many instances, however, this compact arrangement results in the exhaust system having sharp turns or bends which restrict the flow of exhaust therethrough. The exhaust gas back-pressure reduces engine power, especially in two-cycle engines.

An associated problem is that when the engine has multiple cylinders, a compact exhaust system may result in the exhaust flow path corresponding to one cylinder to be different than another cylinder. When the exhaust flow paths for cylinders vary, the operating temperature of the cylinders tends to vary. The cooling and air/fuel charging needs of the cylinders then varies, complicating the design and/or operating conditions of the engine.

Also, exhaust systems for engines powering watercraft are subjected to forces which many other engines are not, especially watercraft vibration. These vibration forces have the tendency to reduce the life of the exhaust system, especially exhaust system mufflers.

An exhaust system for an engine powering a watercraft which overcomes the above-stated problems is desired.

SUMMARY OF THE INVENTION

The present invention is an exhaust system for an engine powering a watercraft. Preferably, the watercraft is of the type having a hull and a front end and a rear end The watercraft has a water propulsion device which is preferably positioned near a rear end of the hull.

The engine is connected to the hull and has an output shaft arranged in driving relationship with the water propulsion device. The engine is mounted towards the front end of the hull from the water propulsion device. The engine is of the internal combustion type, and is provided with an exhaust system for routing exhaust products to a point external to the watercraft.

In one embodiment, the engine has a body defining at least two cylinders, one of which is closer to the front end of the watercraft, and the other which is closer to the rear end. The exhaust system routes exhaust from each cylinder to a discharge at the rear of the watercraft. The exhaust system includes a first portion corresponding to the forward-most cylinder, the first portion extending towards the front end of the watercraft before extending to the rear of the watercraft, the exhaust system includes a second portion corresponding to the rear-most cylinder, this portion extending directly rearwardly.

In another embodiment, the engine has a body which is tilted and defines at least one cylinder having an axis which is offset from vertical. The engine includes an intake system extending from the body in a direction generally opposite vertical from the axis along which the cylinder(s) extend. The exhaust system routes exhaust from each cylinder to a discharge at the rear of the watercraft, and includes a portion which extends under a portion of the engine between the body or intake and a bottom of the hull.

In yet another embodiment, a fuel system associated with the engine includes a fuel tank which is generally positioned forward of the engine. A first portion of an exhaust system corresponding to at least one cylinder extends forwardly along a first side of the fuel tank and then rearwardly along a second side of the tank towards the rear of the watercraft, while a second portion of the exhaust system corresponding to one or more other cylinders extends forwardly along the second side of the fuel tank and then rearwardly along the first side of the fuel tank.

Further objects, features, and advantages of the present invention over the prior art will become apparent from the detailed description of the drawings which follows, when considered the attached figures.

DETAILED DESCRIPTION OF THE PREFERRED EMBODIMENTS OF THE INVENTION

The present invention is an exhaust system for an internal combustion engine arranged to power a watercraft.

Figure 1:
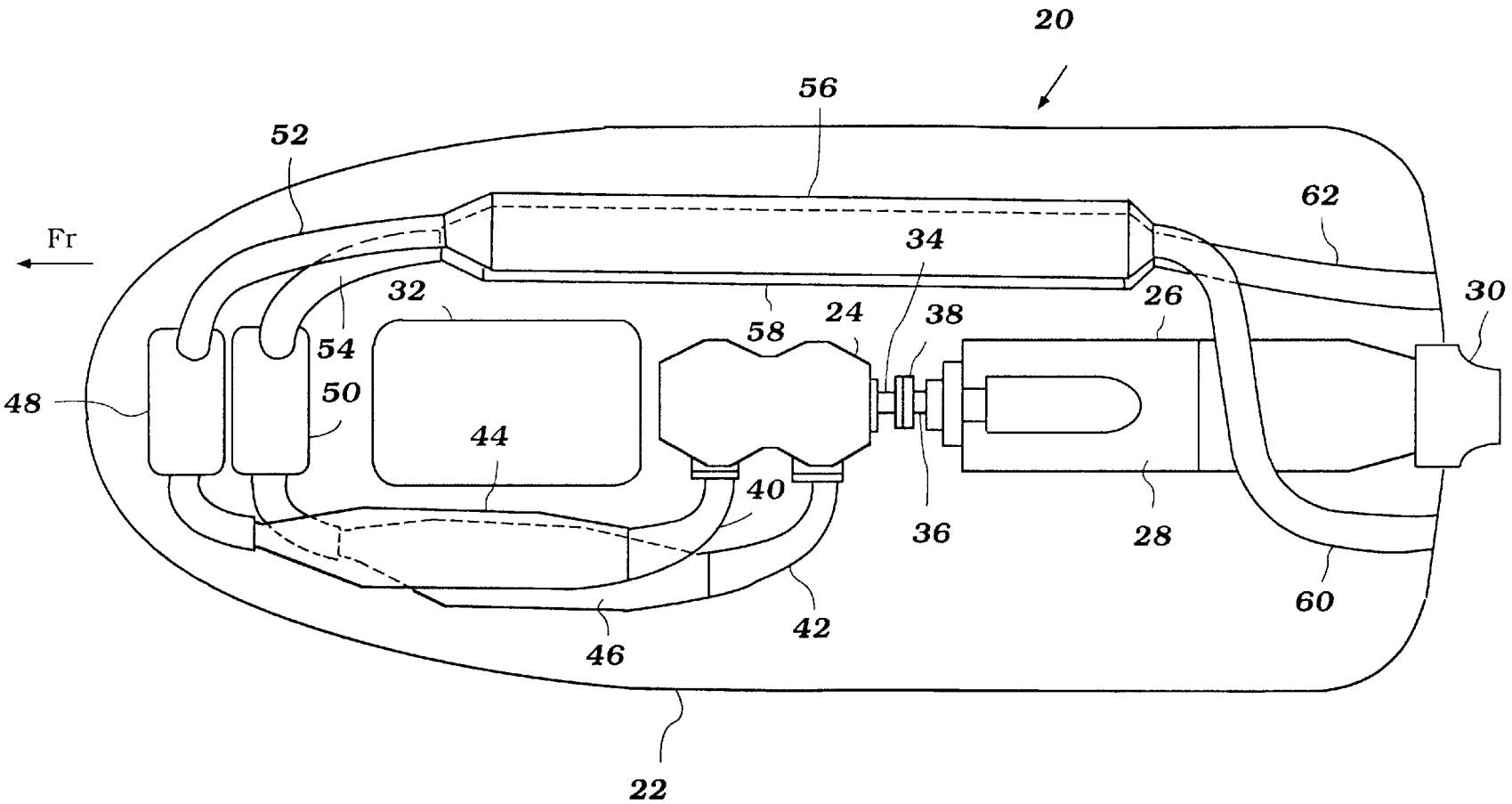
FIG. 1 is a top cross-sectional view of a watercraft powered by an engine and having an exhaust system in accordance with a first embodiment of the present invention.

A first embodiment exhaust system is illustrated in FIG. 1. As illustrated therein, a watercraft 20 includes a hull 22. An internal combustion engine 24 is connected to the hull 22. The details of the watercraft 20 are not generally illustrated nor described since they form no part of the present invention. As such, the watercraft 20 may be arranged in any number of manners. Preferably, the watercraft 20 is of the closed-hull type wherein the engine 24 is positioned in an engine compartment defined by the hull 22.

The watercraft 20 includes a water propulsion device 26 which is powered by the engine 24. As illustrated in FIG. 1, this water propulsion device 26 is a jet-propulsion device having a housing 28 defining a water propulsion passage through which water is drawn by an impeller (not shown) and expelled through an outlet into a steering nozzle 30 positioned at a rear end of the watercraft 20. The steering nozzle 30 is moveable, such as with a steering handle, so that the direction of the watercraft 20 may be controlled.

The engine 24 is preferably of the multi-cylinder variety. Preferably, the engine 24 includes a body 27 defining a pair of cylinders, preferably arranged in in-line fashion. As may be appreciated by those skilled in the art, the engine 24 may operate on a two-cycle or four-cycle principle, may include more than two-cylinders, and may be arranged in other than in-line fashion, such as "V" or opposed. The engine 24 may also be of the rotary type.

Though not illustrated, an air intake system is provided for delivering air to each cylinder. In addition, a fuel delivery system provides fuel to each cylinder for combustion therein. The fuel delivery system preferably includes a fuel tank 32. As illustrated, the fuel tank 32 is preferably positioned in front of the engine 24 (at that end of the engine 24 towards the front of the watercraft 20 opposite the steering nozzle 30, in the direction Fr illustrated in FIG. 1).

A piston (not shown) is positioned in each cylinder and arranged to drive a crankshaft 34 which extends from a rear end of the engine 24 (i.e. the end of the engine 24 generally opposite the fuel tank 32). The crankshaft 34 is coupled to a drive shaft 36 by a coupling 38. The drive shaft 36 extends rearward from the coupling 38 to drive the impeller or other water propulsion device.

In accordance with the present invention, there is provided an improved exhaust system which defines an exhaust flow path for routing the products of combustion from the engine 24 to a point external to the watercraft 20. Preferably, an exhaust passage (not shown) leads from each cylinder through the engine 24 generally to one side thereof (facing a side of the hull 22). A first exhaust pipe 40 is connected to the engine 24 and has a passage therethrough aligned with the passage leading from a first of the cylinders. A second exhaust pipe 42 is connected to the engine 24 and has a passage therethrough aligned with the passage leading from a second of the cylinders. The first and second exhaust pipes 40,42 preferably extend outwardly from the side of the engine 24 and then curve towards the front of the watercraft 20. The first and second exhaust pipes 40,42 are connected to first and second upstream mufflers 44,46 respectively. These mufflers 44,46 are elongate and generally extend parallel to the crankshaft 34 along one side of the fuel tank 32.

The upstream mufflers 44,46 preferably extend slightly beyond the fuel tank 32 at a front end of the watercraft 20 and are connected to first and second water locks 48,50 respectively. These water locks 48,50 may be of a variety of types known to those skilled in the art and arranged to prevent the backflow of water through the exhaust system to the engine 24. The water locks 48,50 are preferably positioned in front of the fuel tank 32 (i.e. towards the front end of the watercraft 20 and on the opposite side of the tank 32 from the engine 24).

First and second exhaust pipes or hoses 52,54 lead from the waterlocks 48,50 to first and second downstream mufflers 56,58. The downstream mufflers 56,58 are generally elongate and extend towards the rear of the watercraft 20 along a second side of the fuel tank 32 and the side of the engine 24 generally opposite the first and second exhaust pipes 40,42 extending from the engine 24.

As illustrated, a discharge exhaust pipe 60,62 extends from each downstream muffler 56,58 through the hull 22 of the watercraft 20 to a discharge external to the watercraft. As will be understood, the various parts of the exhaust system define a passage therethrough through which exhaust flows and is routed from the passage through the engine 24 corresponding to a cylinder to the discharge point external to the watercraft 20. As illustrated, one of the pipes 60 preferably discharges on one side of the steering nozzle 30, while the other pipe 62 discharges on the opposite side of the nozzle 30.

The exhaust system just described thus defines a flow path from the engine 24 towards the front end of the hull 22 along one side of the fuel tank 32, and then along a second side of the fuel tank towards the rear of the watercraft 20 to a discharge.

The exhaust system of the present invention has several distinct advantages over exhaust systems of the prior art. First, the exhaust system occupies otherwise unused space within the engine compartment, thereby opening up additional space for the engine and related components.

Second, the exhaust system is arranged so that the exhaust path from the engine 24 to discharge for the exhaust corresponding to each cylinder is nearly equal. In this manner, both cylinders have generally the same exhaust system back-pressure associated therewith, whereby the operating conditions of the cylinders are not substantially different.

Further, the exhaust system is generally symmetrically arranged around the engine 24 within the engine compartment. Most importantly, the exhaust system follows a path which allows the pathway to be generally unrestricted, i.e. there are no very sharp bends, reducing the exhaust back-pressure and improving engine operating performance.

Figure 2:
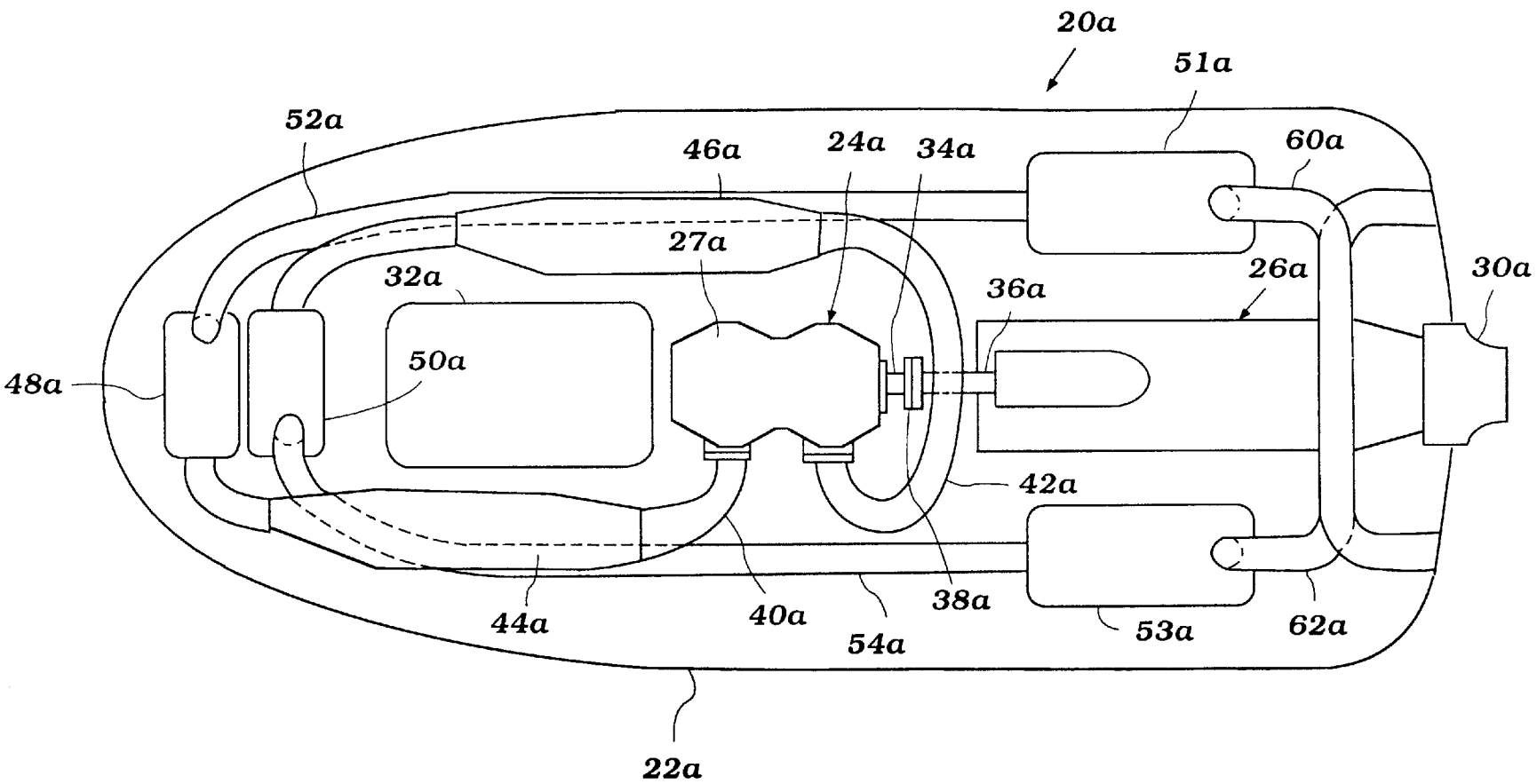
FIG. 2 is a top cross-sectional view of a watercraft powered by an engine and having an exhaust system in accordance with a second embodiment of the present invention.

FIG. 2 illustrates a watercraft 20*a* powered by an engine 24*a* and having an exhaust system in accordance with a second embodiment of the present invention. In the illustration and description of this embodiment, like reference numerals have been used with similar parts to those of the first embodiment, except that an "a" designator has been added to all reference numerals of this embodiment.

As in the first embodiment, the engine 24*a* has a crankshaft 34*a* arranged to drive a drive shaft 36*a* through a coupling 38*a*. The drive shaft 36*a* drives an impeller or similar member of a water propulsion device 28*a*.

The exhaust system of this embodiment of the present invention includes a first exhaust pipe 40*a* connected to the engine 24*a* and leading from the exhaust passage leading from a first cylinder, and a second exhaust pipe 42*a* connected to the engine 24*a* and leading from the exhaust passage leading from a second cylinder. The first exhaust pipe 40*a* curves outwardly and forwardly from the engine 24*a* towards a first muffler 44*a*, which in turn leads to a water lock 48*a* positioned at the front end of the watercraft 20*a* in front of the fuel tank 32*a*.

An exhaust pipe 52*a* leads from the water lock 48*a* along the opposite side of the engine from the first muffler 44*a* to a secondary water lock 51*a* near the rear of the watercraft 20*a*. An exhaust pipe 60*a* extends from this secondary water lock 51*a* to a discharge at the rear of the watercraft 20*a*.

The second exhaust pipe 42*a* preferably leads from the exhaust passage leading from the rear-most cylinder. This exhaust pipe 42*a* extends outwards from the side of the engine before curving around the rear of the engine 22*a* to a second muffler 46*a* positioned along the opposite side of the engine 22*a* (i.e. along the side that the exhaust pipe 52*a* extends).

This muffler 46*a* extends to a waterlock 50*a* also positioned at the front of the watercraft 20*a* in front of the fuel tank 32*a*. An exhaust pipe 54*a* extends from the water lock 50*a* along the side of the tank 32*a* and engine 22*a* (along the same side of the engine 22*a* from which the first and second exhaust pipes 40*a*,42*a* extend) to a secondary waterlock 53*a* near the rear of the watercraft 20*a*. An exhaust pipe 62*a* extends from this secondary waterlock 53*a* to a discharge. This exhaust pipe 62*a* is arranged in conjunction with the corresponding exhaust pipe 60*a* leading from the other secondary waterlock 51*a* to cross.

As illustrated, the paths of the exhaust flow from the front and rear cylinders cross (i.e. flow in opposite directions) at the front of the watercraft 20*a* and at the rear of the watercraft 20*a*.

This exhaust system has similar advantages to those of the first embodiment. In addition, exhaust system is "balanced" on each side of the engine 24*a* so as to be generally symmetric with respect to the hull of the watercraft 20*a*. Also, this system includes two water locks along each exhaust path, reducing the probability of water entering the engine 24*a*, and permitting each individual water lock to be smaller.

Figure 3:
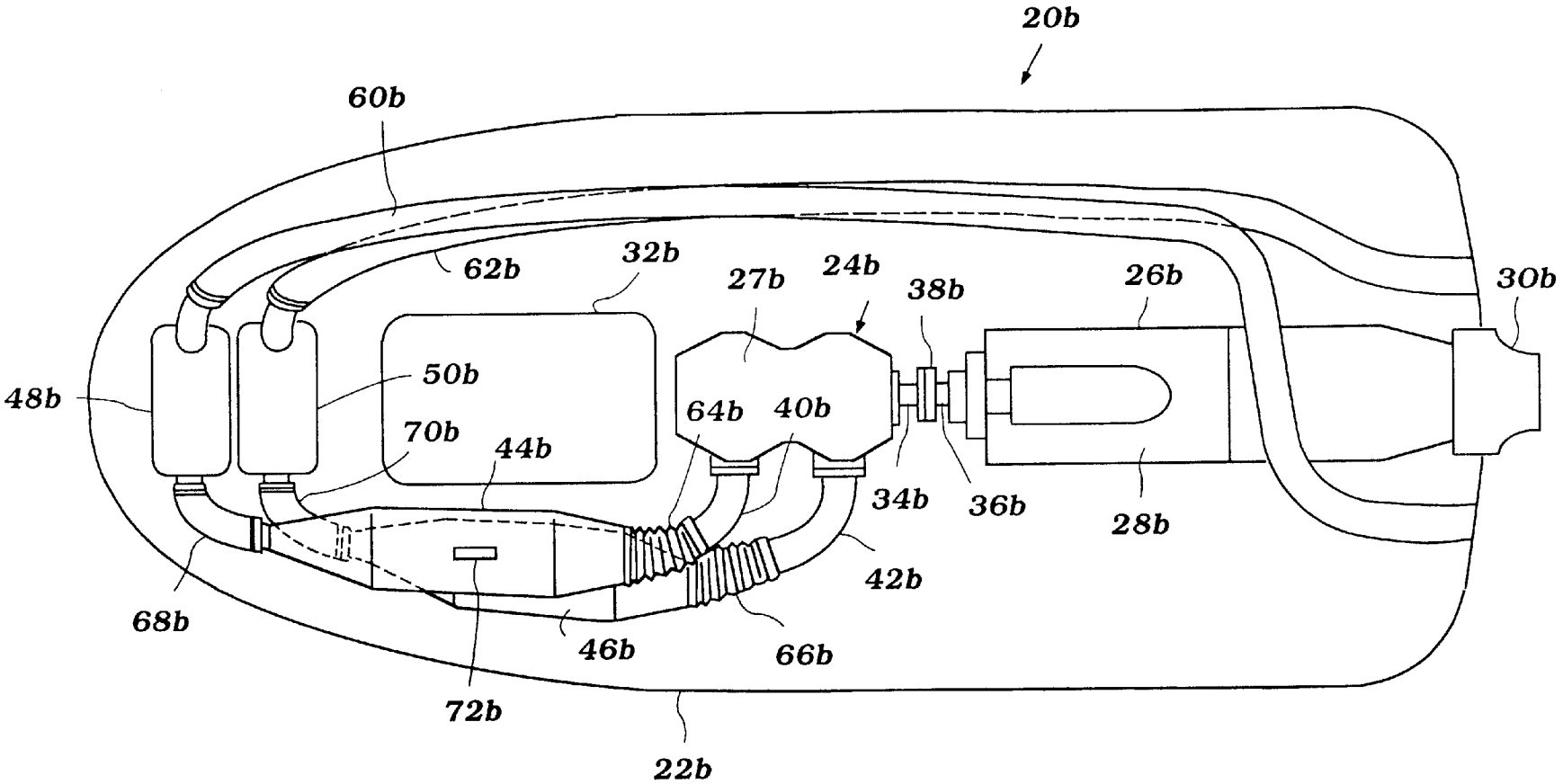
FIG. 3 is a top cross-sectional view of a watercraft powered by an engine and having an exhaust system in accordance with a third embodiment of the present invention.
Figure 4:
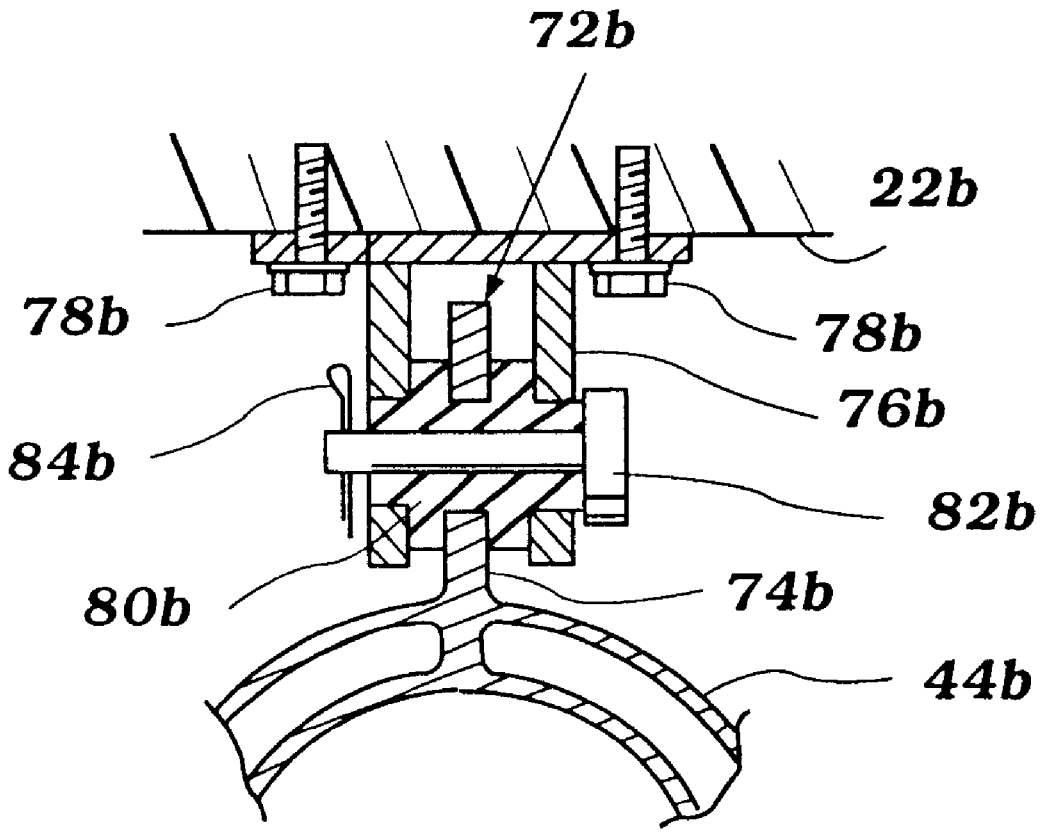
FIG. 4 is an enlarged cross-sectional view of a mounting for a muffler of the third embodiment exhaust system illustrated in FIG. 3.
Figure 5:
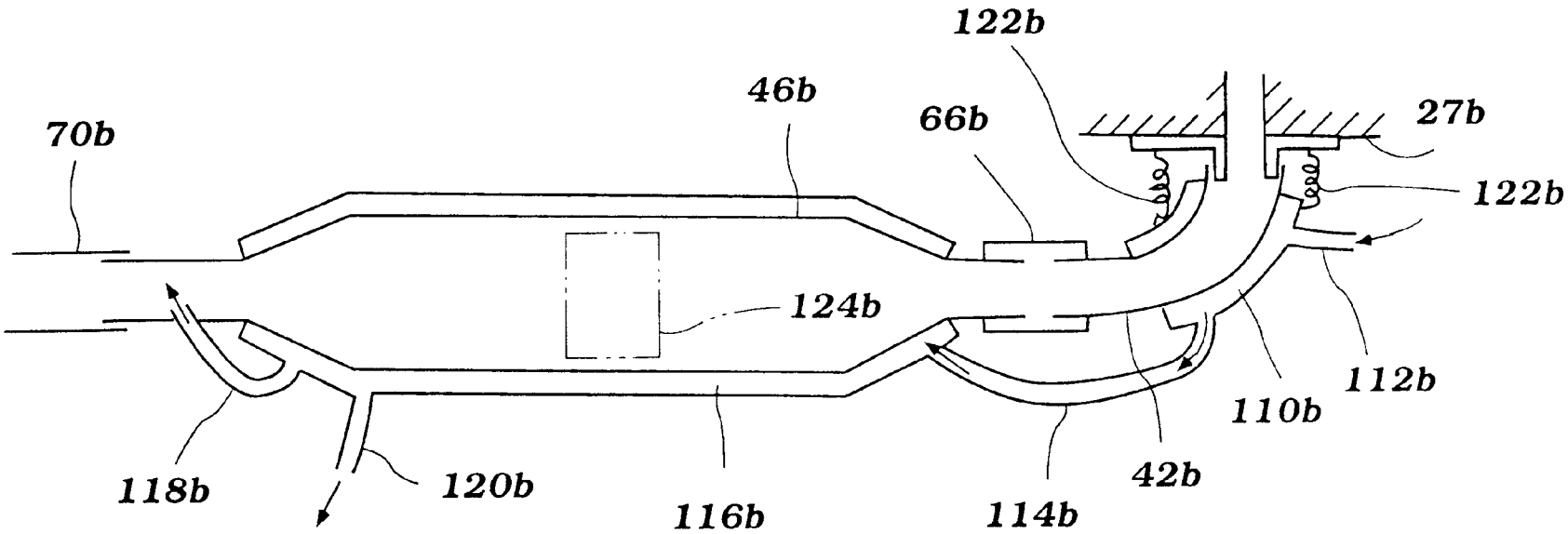
FIG. 5 is a cross-sectional view of a portion of the exhaust system illustrated in FIG. 3, illustrating an alternate arrangement thereof wherein a cooling system is provided.

FIGS. 3–5 illustrate a watercraft 20*b* powered by an engine 24*b* and having an exhaust system in accordance with a third embodiment of the present invention. In the illustration and description of this embodiment, like reference numerals have been used with similar parts to those of the prior embodiments, except that a "b" designator has been added to all reference numerals of this embodiment.

As in the prior embodiment, the engine 24*b* has a crankshaft 34*b* arranged to drive a drive shaft 36*b* through a coupling 38*b*. The drive shaft 36*b* drives an impeller or similar member of a water propulsion device 28*b*.

The exhaust system of this embodiment of the present invention includes a first exhaust pipe 40*b* connected to the engine 24*b* and leading from the exhaust passage leading from a first cylinder, and a second exhaust pipe 42*b* connected to the engine 24*b* and leading from the exhaust passage leading from a second cylinder. These exhaust pipes 40*b*,42*b* curve outwardly and forwardly from the engine 24*b* towards first and second mufflers 44*b*,46*b*.

As illustrated, a flexible coupling 64*b* is provided between the first exhaust pipe 40*b* and corresponding muffler 44*b*. A similar coupling 66*b* is provided between the second exhaust pipe 42*b* and corresponding muffler 46*b*. These couplings 64*b*,66*b*, may comprise resilient hoses, metal conduits or the like.

As in the first embodiment, the mufflers 46*b* extend towards a front end of the engine 24*b* along a fuel tank 32*b*. A pair of water locks 48*b*,50*b* are positioned near the front end of the watercraft 20*b* in front of the fuel tank 32*b*. An exhaust pipe or hose 68*b* extends from a first of the mufflers 44*b* to a first water lock 48*b*, while a similar exhaust pipe or hose 70*b* extends from the other muffler 46*b* to the other water lock 50*b*.

A first discharge exhaust pipe 60*b* extends from a first of the water locks 48*b* around the other side of the fuel tank 32*b* and along the side of the engine 24*b* opposite the mufflers 44*b*,46*b* and through the hull 22*b* at a rear end of the watercraft 20*b*. A second discharge exhaust pipe 62*b* extends from a second of the water locks 50*b* around the same side of the fuel tank 32*b* and long the side of the engine 24*b* opposite the mufflers 44*b*,46*b* and through the hull 22*b* at the rear end of the watercraft 20*b*.

The exhaust flow path of the exhaust system of this embodiment of the invention is similar to the first, flowing from the engine towards the front of the watercraft along one side of the fuel tank, and then along another side of the fuel tank towards the rear of the engine.

This exhaust system generally has the advantages of the exhaust system of the first embodiment and has the added advantage that the transmission of engine vibration to the mufflers 44*b*,46*b* is reduced. As illustrated in FIG. 1, in the first embodiment the exhaust pipes are rigidly connected to the upstream mufflers and support them. In this embodiment, the flexible couplings 64*b*,66*b* serve to isolate the mufflers 44*b*,46*b* from engine vibration transmitted to the exhaust pipes 40*b*,42*b* which are coupled to the engine 24*b*.

Since the exhaust pipes 40*b*,42*b* do not support the mufflers 44*b*,46*b*, a mounting 72*b* is provided for removably coupling the mufflers 44*b*,46*b* to the watercraft 20*b*. Referring primarily to FIG. 4, a mounting flange 74*b* extends generally vertically upward from the muffler 44*b*. A bracket 76*b* is connected to the hull 22*b* of the watercraft 20*b*. The bracket 76*b* is preferably connected to the hull 22*b* via a pair of bolts 78*b* or similar fasteners. The bracket 76*b* depends downwardly from the hull 22*b* and has a pair of spaced legs.

A pin 82*b* extends through a passage in each leg of the bracket 76*b* and a passage through the flange 74*b* when positioned between the legs of the bracket 76*b*. A resilient elastomer 80*b* is positioned about the pin 82*b* and separate the pin 82*b* from the bracket 76*b* and flange 74*b*, and the flange 74*b* from the legs of the bracket 76*b*. A cotter pin 84*b* is preferably provided for maintaining the pin 82*b* in position.

A similar mounting is preferably provided for the other muffler 46*b*. The mounting 72*b* has the advantage that the muffler 44*a* is removably connected to the watercraft 20*b* and yet is supported thereby. In addition, the mounting 72*b* is arranged to prevent the transmission of watercraft 20*b* vibration to the muffler 44*b* serving to increase the life of the muffler.

FIG. 5 illustrates a more specific mounting arrangement for the exhaust pipes extending from the engine 24*b* and the muffler connected thereto. In this Figure, only one exhaust pipe 42*b* and muffler 46*b* are illustrated, it being understood that the other exhaust pipe 40*b* and muffler 44*b* may be similarly arranged.

As illustrated, a cooling jacket 110*b* is provided about the outside of at least a portion of the exhaust pipe 42*b*. Coolant, such as water from the body of water in which the watercraft is operating, is delivered through a supply pipe or hose 112*b* to the jacket 110*b*.

Preferably, this same coolant is then routed through a supply hose or pipe 114*b* to a coolant jacket 116*b* surrounding at least a portion of the muffler 46*b*. The coolant then passes through one or more drain hoses 118*b*,120*b* therefrom. The coolant may then be delivered to the engine or to a point external to the watercraft.

As also illustrated, the exhaust pipe 42*b* is resiliently coupled to the engine 24*b* body with one or more springs 122*b*. This permits the exhaust pipe 42*b* to move to some degree with respect to the engine 24*b* and watercraft 20*b*, dampening vibrations and extending the life of the exhaust system. Of course, this flexible mounting may be provided along with the resilient mounting illustrated in FIGS. 3 and 4 for the muffler 44*b* so that this entire portion of the exhaust system is resiliently mounted. When a catalyst 124*b* is provided in the muffler 46*b*, this arrangement also serves to protect the catalyst from damage from vibration.

Figure 6:
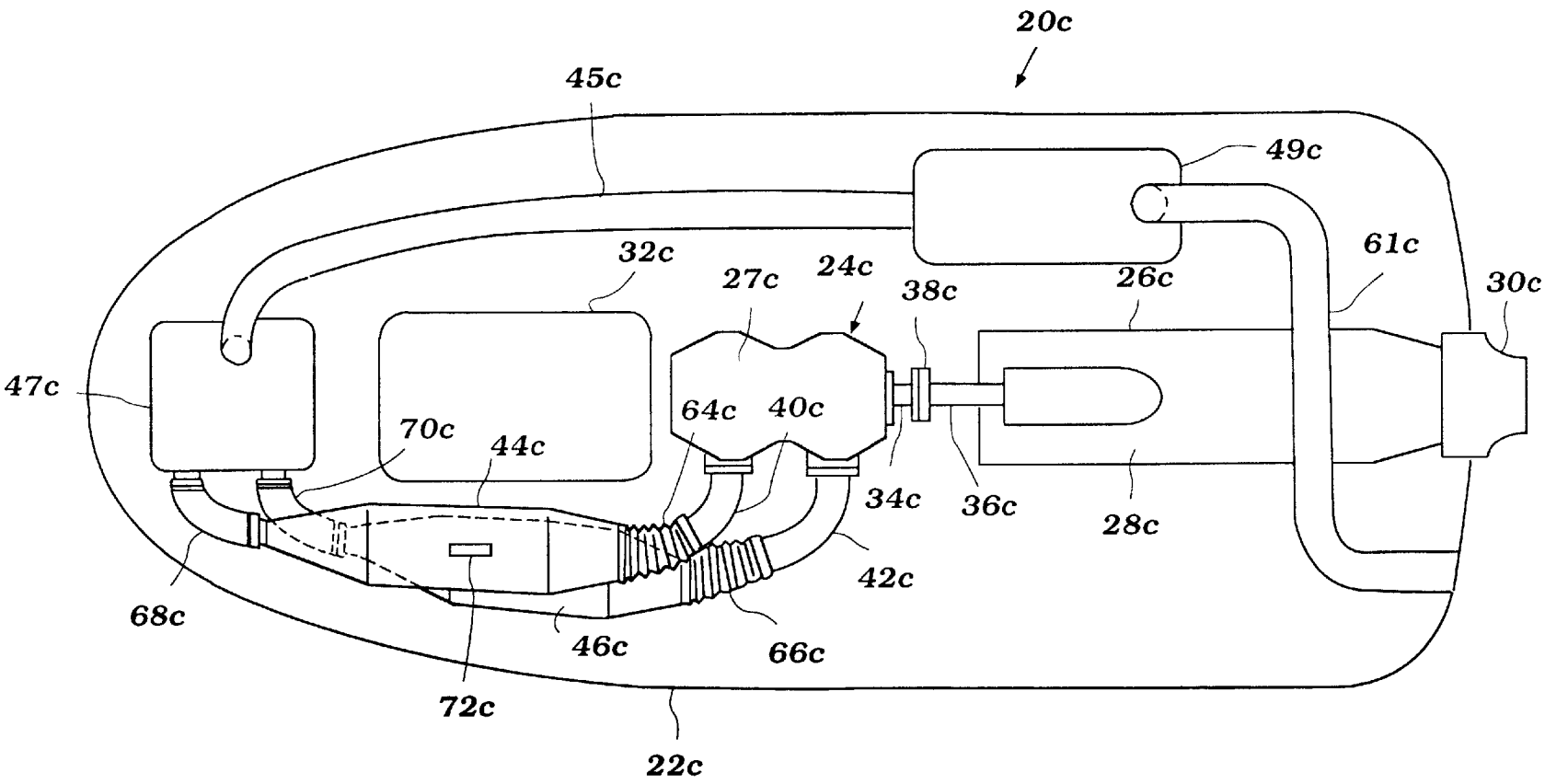
FIG. 6 is a top cross-sectional view of a watercraft powered by an engine and having an exhaust system in accordance with a fourth embodiment of the present invention.

FIG. 6 illustrates a watercraft 20*c* powered by an engine 24*c* and having an exhaust system in accordance with a fourth embodiment of the present invention. In the illustration and description of this embodiment, like reference numerals have been used with similar parts to those of the prior embodiments, except that a "c" designator has been added to all reference numerals of this embodiment.

This embodiment exhaust system is similar to that illustrated in FIG. 3, with first and second exhaust pipes 40*c*,42*c* extending from the engine 24*c* through flexible couplings 64*c*,66*c*, to first and second mufflers 44*c*,46*c*. These mufflers 44*c*,46*c*, extend along the side of the engine 24*c* and fuel tank 24*c* towards the front of the watercraft 20*c*.

Connecting pipes 68*c*,70*c* connect the mufflers 44*c*,46*c*, to a single waterlock 47*c* positioned at the front end of the watercraft 20*c* in front of the fuel tank 32*c*. A single exhaust pipe 45*c* extends from this waterlock 47*c* along the opposite side of the engine 24*c* from that which the first and second exhaust pipes 40*c*,42*c* extend. This exhaust pipe 45*c* extends towards the rear of the watercraft 20*c* to a secondary waterlock 49*c*. A discharge exhaust pipe 61*c* extends from this secondary waterlock 49*c* to a discharge. As illustrated, the discharge exhaust pipe 61*c* preferably extends from one side of the watercraft 20*c* where the secondary waterlock 49*c* is located to the opposite side to discharge.

This embodiment exhaust system again has the advantageous of having large radius bends thus reducing exhaust gas backpressure. In addition, the system has the advantage of two water locks 47*c*,49*c*, but includes but a single exhaust pipe 45*c*,61*c*, thus reducing the space occupied by the exhaust system.

FIGS. 7–10 illustrate a watercraft 20*d* powered by an engine 24*d* and having an exhaust system in accordance with a fifth embodiment of the present invention. In the illustration and description of this embodiment, like reference numerals have been used with similar parts to those of the prior embodiments, except that a "d" designator has been added to all reference numerals of this embodiment.

As in the prior embodiments, the engine 24*d* is arranged to drive an impeller or similar device of a water propulsion unit 26*d* of the watercraft 20*d*. In this embodiment, the housing 28*d* of the water propulsion unit 26*d* extends beyond the hull 22*d* at the rear end of the watercraft 20*d*.

Preferably, the portion of the housing 28*d* extending beyond the hull 22*d* is supported by a support member 86*d*. As illustrated, the support member 86*d* generally surrounds the housing 28*d* and preferably has a curved outer surface corresponding to that portion which faces downwardly into the water. First and second straps 88*d* provide lateral support to the support member 86*d*, extending from a connection at one end to the hull 22*d* to the member 86*d*.

Figure 7:
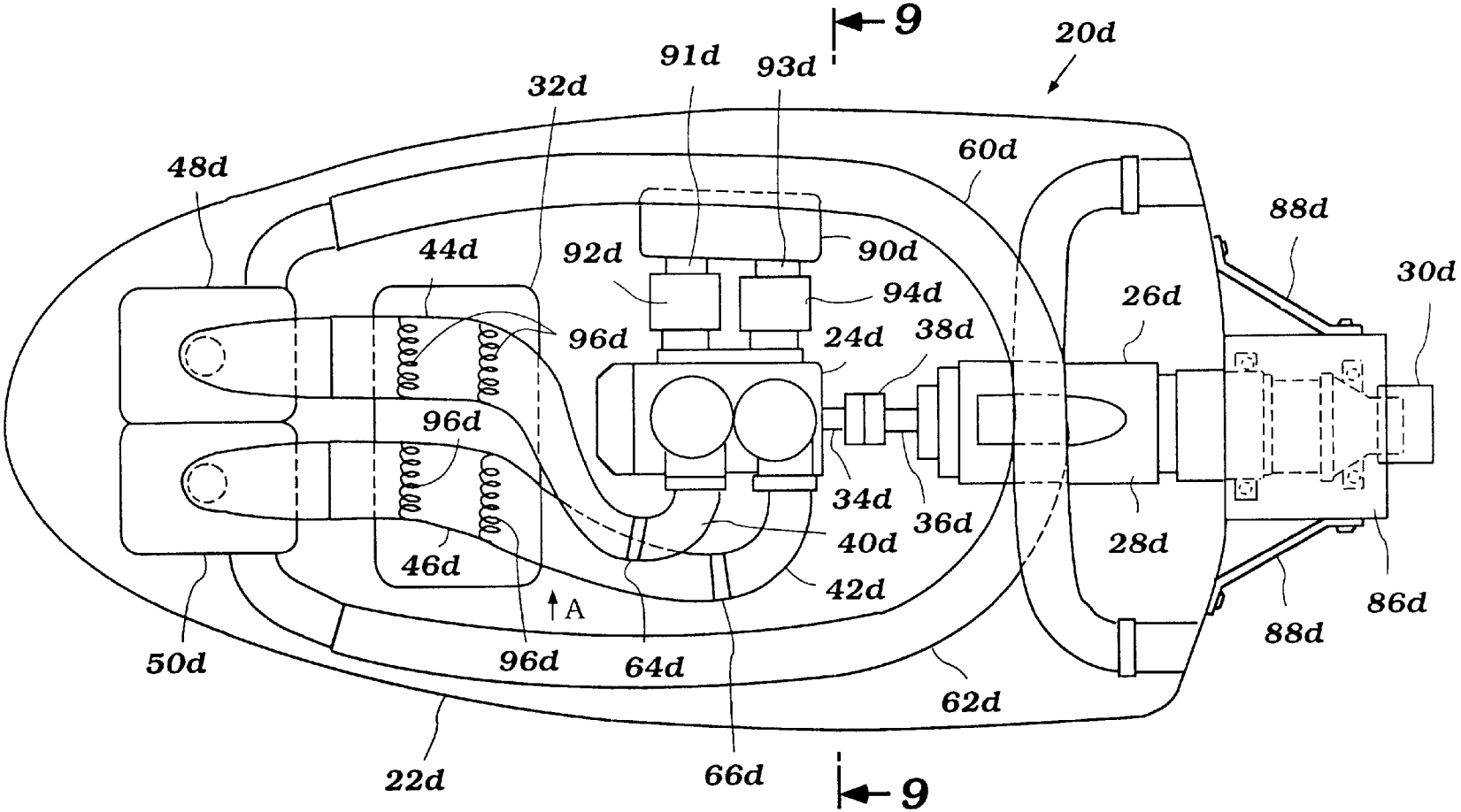
FIG. 7 is a top cross-sectional view of a watercraft powered by an engine and having an exhaust system in accordance with a fifth embodiment of the present invention.
Figure 9:
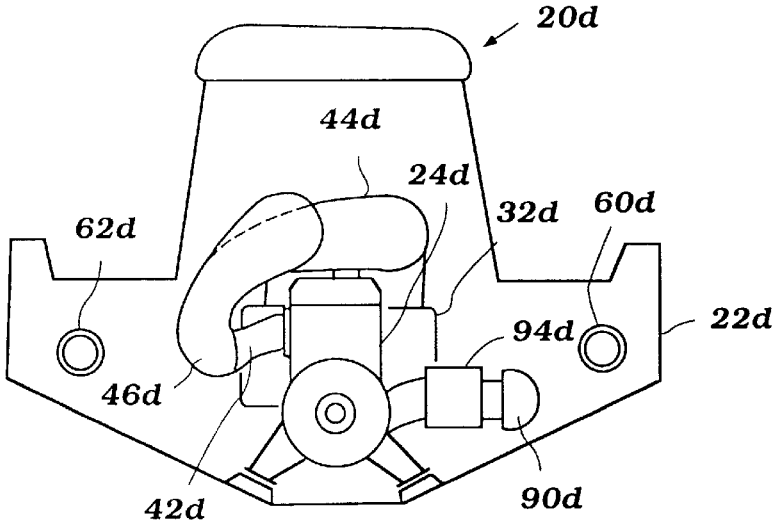
FIG. 9 is a cross-sectional view of the watercraft and exhaust system illustrated in FIG. 7 and taken along line 9—9 therein.
Figure 10:
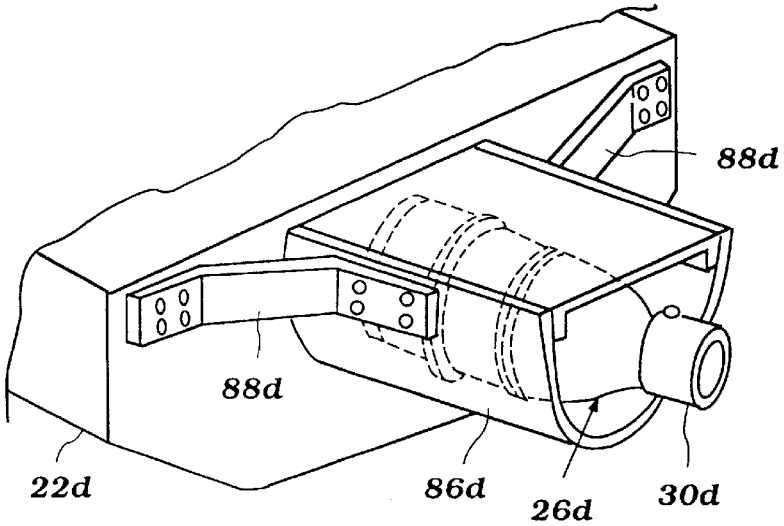
FIG. 10 is an enlarged perspective view of a rear portion of the watercraft illustrated in FIG. 7.

FIGS. 7 and 9 illustrate a part of the air intake system and fuel delivery system of the engine 24*d*. Air is preferably drawn from within the engine compartment through an intake silencer 90*d*. Air then passes through first and second intake passages 91*d*,93*d* leading from the silencer 90*d* to first and second carburetors 92*d*,94*d*. Each carburetor 92*d*, 94*d* is arranged to deliver fuel into air passing therethrough. The resultant fuel and air mixture is then delivered to a corresponding cylinder for combustion.

Figure 8:
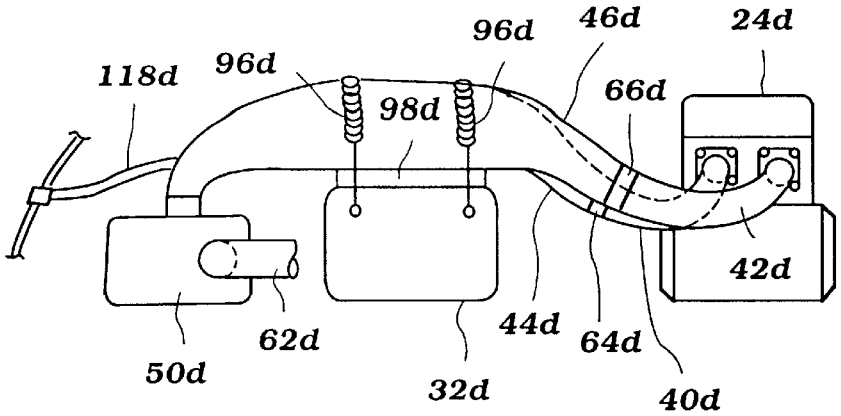
FIG. 8 is a side view of the exhaust system illustrated in FIG. 7 taken in the direction of arrow A therein.

The exhaust system of this embodiment of the invention is best illustrated in FIGS. 7–9. As illustrated, first and second exhaust pipes 40*d*,42*d* again extend outwardly from a side of the engine 24*d* and curve forwardly towards first and second mufflers 44*d*,46*d*. In this embodiment, resilient couplings 64*d*,66*d* are preferably provided between the pipes 40*d*,42*d* and their respective mufflers 44*d*,46*d*.

Preferably, the mufflers 44*d*,46*d* extend generally in front of the engine 24*d* generally above the fuel tank 32*d*. The mufflers 44*d*,46*d* each lead to a water lock 48*d*,50*d* positioned at the front end of the watercraft 20*d* in front of the fuel tank 32*d*.

A discharge exhaust pipe 60*d*,62*d* extends from the water lock 48*d*,50*d* through the housing 28*d* of the water propulsion device 26*d* for discharge into the water therein. In this manner the exhaust is expelled out the rear end of the watercraft with water flowing through the housing 28*d*.

In this embodiment the exhaust pipes 40*d*,42*d* again do not rigidly support the mufflers 40*d*,42*d*. Support for the mufflers 40*d*,42*d* is preferably provided by multiple springs 96*d* connected to a mounting part 98*d* provided on the fuel tank 32*d*. This spring mounting 96*d* provides resilient support for the mufflers 40*d*,42*d*.

The water propulsion unit 26*d* as arranged in this embodiment has the benefit that the water intake is positioned nearer the rear of the watercraft than in other embodiments. Thus, when the watercraft 20*d* is in its planing position, the possibility of air being introduced into the water propulsion unit is reduced. This increases the efficiency of the water propulsion device, allowing the watercraft to achieve a higher speed. This propulsion arrangement also results in improve turning ability and handling since the thrust point is moved rearward, and because the mounting 86*b* is curved on its bottom, the resistance is reduced.

Because the propulsion unit 26*d* is moved rearward, the exhaust discharge pipes 60*d*,62*d* can advantageously discharge into the housing 28*d* (instead of through the rear of the hull 22*d*) without being tightly curved and thus restricting the exhaust flow. In addition, the exhaust system is again isolated from engine and watercraft vibration.

In the previous embodiments, the first and second sides of the fuel tank along which the exhaust path extends are opposing sides of the tank which face the sides of the watercraft or hull. In this embodiment, however, the first side of the fuel tank 32*d* comprises a top side of the fuel tank, while the second side comprises the sides facing side of the hull or watercraft.

Figure 11:
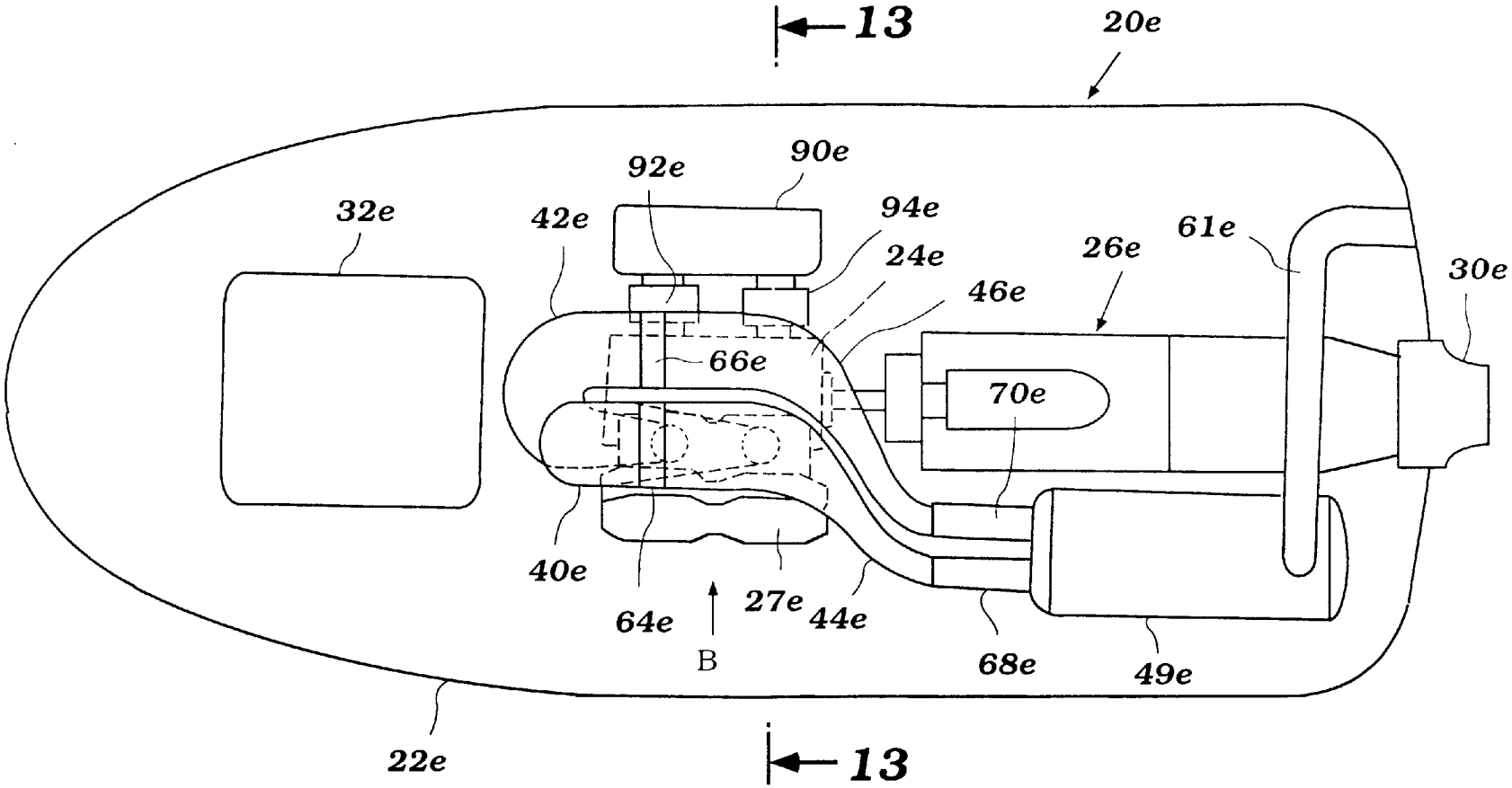
FIG. 11 is a top cross-sectional view of a watercraft powered by an engine and having an exhaust system in accordance with a sixth embodiment of the present invention.
Figure 12:
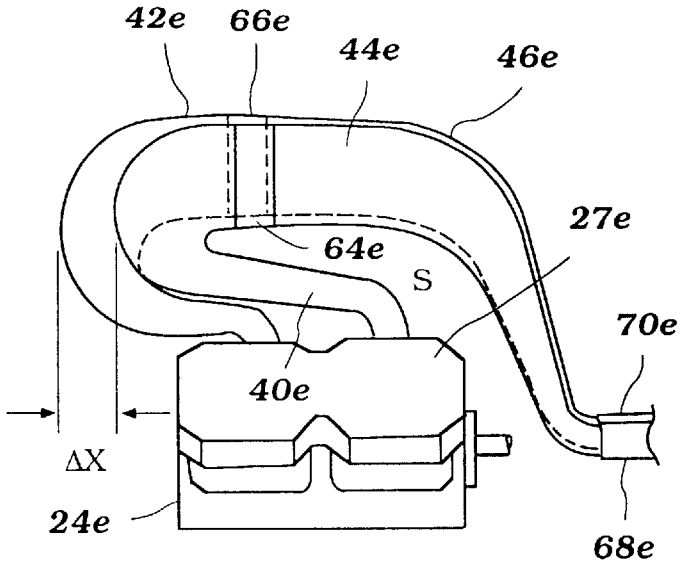
FIG. 12 is a side view of the exhaust system illustrated in FIG. 11 and taken in the direction of arrow B therein.
Figure 13:
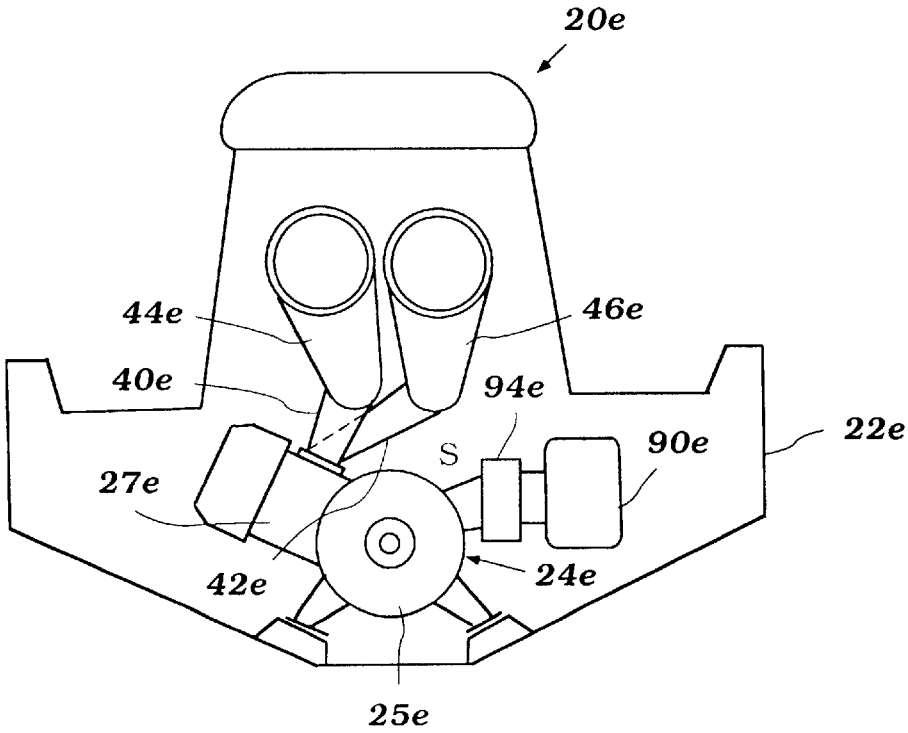
FIG. 13 is a cross-sectional view of the watercraft and exhaust system illustrated in FIG. 11 taken in the direction of line 13—13 therein.

FIGS. 11–13 illustrate a watercraft 20*e* powered by an engine 24*e* and having an exhaust system in accordance with a sixth embodiment of the present invention. In the illustration and description of this embodiment, like reference numerals have been used with similar parts to those of the prior embodiments, except that an "e" designator has been added to all reference numerals of this embodiment.

As in the prior embodiments, the engine 24*e* preferably has a pair of cylinders having pistons which drive a crankshaft which drives a water propulsion device 26*e* having a discharge in a steering nozzle 30*e* positioned at the rear of the watercraft 20*e*. The engine 24*e* is preferably operates on a two-cycle principle and has its cylinders leaning in a direction slightly above horizontal.

As best illustrated in FIG. 13, the air intake is preferably arranged so that the silencer 90*e* and carburetors 92*e*,94*e* are positioned along one side of the engine 24*e*. The air and fuel charge created thereby is supplied to a crankcase 25*e* portion of the engine 24*e* (the engine operating on a two-cycle crankcase compression cycle and being appropriately arranged, as well known to those of skill in the art), and connected to the crankcase 25*e* generally opposite the side thereof to which the cylinders extend. In this arrangement, a valley or open space S is created above the engine 24*e* between that portion defining the cylinders and that the intake system.

The exhaust system includes a first exhaust pipe 40*e* extending from the engine 24*e* and having a passage therethrough aligned with an exhaust passage leading from a first of the cylinders. A second exhaust pipe 42*e* extends from the engine 24*e* and has a passage aligned with an exhaust passage leading from a second of the cylinders.

As best illustrated in FIGS. 12 and 13, the exhaust pipes 40*e*,42*e* preferably extend generally vertically upward from the top of the engine 24*e* into the space S. After extending up from the engine 24*e*, the exhaust pipes 40*e*,42*e* extend forward towards the front of the engine before bending up and rearwardly towards a muffler 44*e*,44*e*.

The exhaust pipes 40*e*,42*e* are preferably connected to a respective muffler 44*e*,44*e* via a resilient coupling, such as a rubber hose 64*e*,66*e*. The mufflers 44*e*,44*e* extend generally rearward through the space S above the engine 24*e* before curving downward to a single water lock 49*e*. Preferably, each muffler 44*e*,44*e* is connected to the water lock 49*e* via a resilient coupling such as a rubber hose 68*e*,70*e*. A single discharge exhaust pipe 61*e* leads from the water lock 49*e* through the hull 22*e* at the rear of the watercraft 22*e*.

The exhaust system of this embodiment has the similar advantages to those described above in conjunction with the other embodiments. First, because of the layout of the engine 24*e* resulting in the space S, the exhaust system may have a compact arrangement in conjunction with the engine, minimizing the engine compartment size and lending to a smaller watercraft size.

Another advantage of the invention is that the exhaust path corresponding to each cylinder is nearly equal. In this regard, and referring to FIG. 12, the second exhaust pipe 42*e* preferably extends forwardly of the first exhaust pipe 40*e* by an amount ΔX so that the exhaust paths are of the same length (this compensates for the fact that the exhaust ports are arranged so that one is forward of the other and thus the exhaust pipes 40*e*,42*e* are connected to the engine at different locations therealong).

The resilient coupling of the exhaust pipes 40*e*,42*e* to the mufflers 44*e*,44*e* and the resilient coupling of the mufflers 44*e*,44*e* to the water lock 49*e* advantageously reduces the transmission of engine and watercraft vibration to the mufflers 44*e*,44*e* serving to increase the life thereof.

Figure 14:
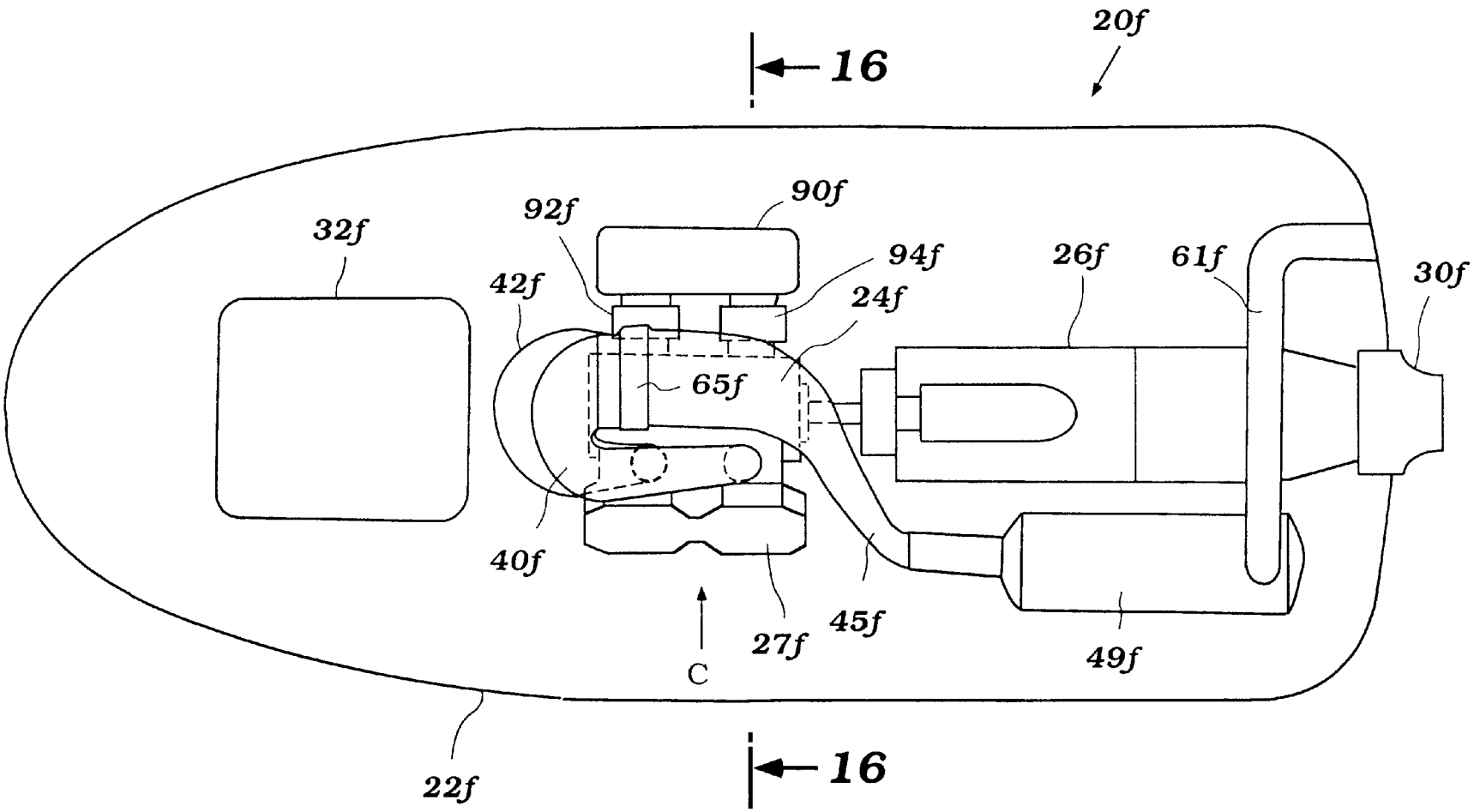
FIG. 14 is a top cross-sectional view of a watercraft powered by an engine and having an exhaust system in accordance with a seventh embodiment of the present invention.
Figure 15:
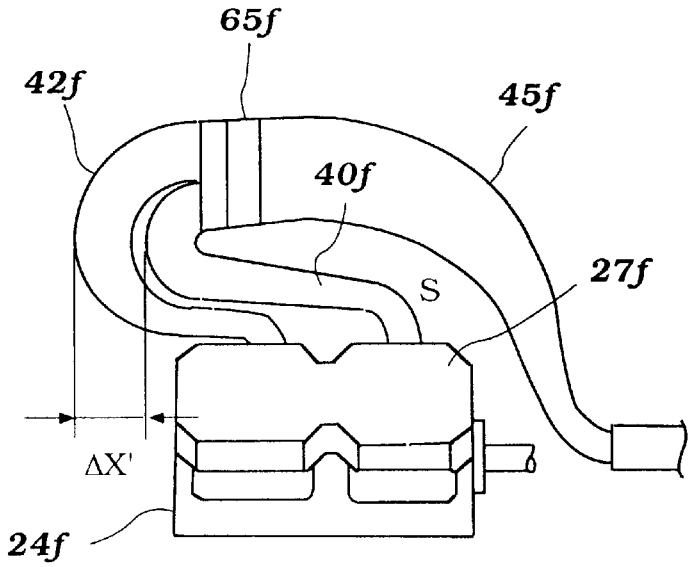
FIG. 15 is a side view of the exhaust system illustrated in FIG. 14 and taken in the direction of arrow C therein.
Figure 16:
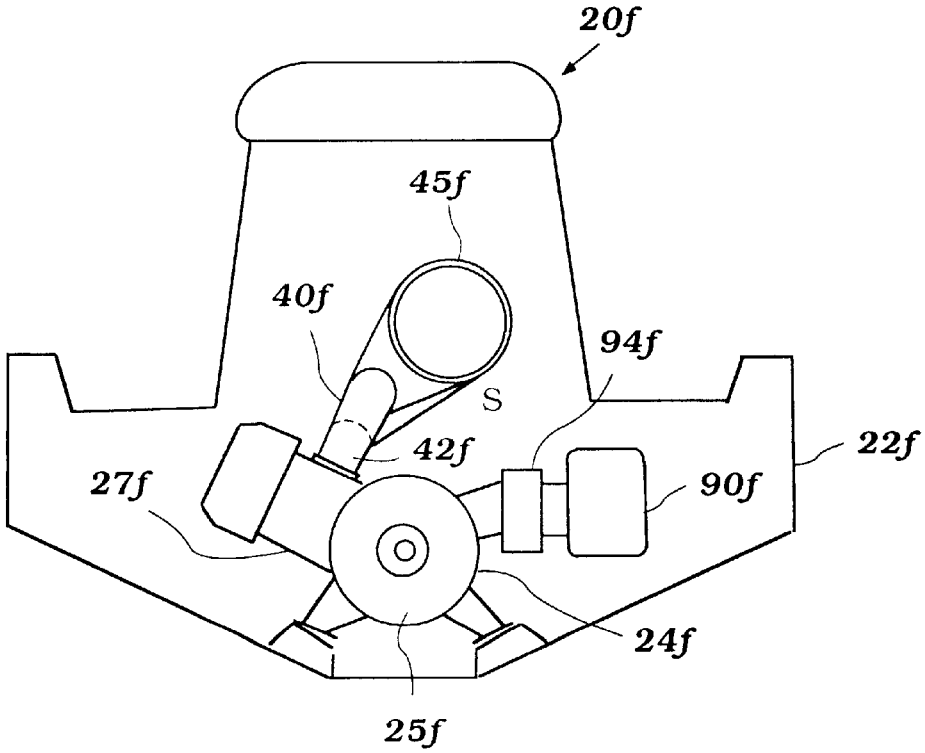
FIG. 16 is a cross-sectional view of the watercraft and exhaust system illustrated in FIG. 14 taken in the direction of line 16—16 therein.

FIGS. 14–16 illustrate a watercraft 20*f* powered by an engine 24*f* and having an exhaust system in accordance with a seventh embodiment of the present invention. In the illustration and description of this embodiment, like reference numerals have been used with similar parts to those of the prior embodiments, except that an "f" designator has been added to all reference numerals of this embodiment.

In this embodiment, the engine 24*f* is arranged in similar fashion to that illustrated in FIGS. 11–13 where a space S is defined above the engine 24*f* between the air intake and that portion of the engine defining the cylinders.

The exhaust system again includes an exhaust pipe 40*f*, 42*f* extending from the exhaust passage corresponding to each cylinder. The exhaust pipes 40*f*,42*f* extend up and then towards the front end of the engine before bending up and towards the rear end of the engine to a single muffler or expansion pipe 45*f*. The muffler 45*f* extends through the space S to the rear of the engine 24*f* before bending downwardly to a single water lock 49*f*. A single exhaust discharge pipe 61*f* preferably extends from the water lock 49*f* through the hull 22*f* at the rear of the watercraft 20*f* for routing exhaust gases into the water.

Preferably, the exhaust pipes 40*f*,42*f* are connected to the muffler 45*f* via a resilient coupling 65*f*, such as a rubber hose.

The exhaust system of this embodiment has generally the same advantages as those of the embodiment illustrated in FIGS. 11–13. Once again, the exhaust path from each cylinder to discharge is nearly equal. In this regard, the exhaust pipe 42*f* corresponding to the forward most cylinder (and thus forward most exhaust passage through the engine) extends towards the front end of the engine 24*f* by a distance ΔX' greater than the distance that the other exhaust pipe 40*f* extends towards the front end of the engine. In this manner, the exhaust pipes 40*f*,42*f* each define an exhaust path which is of the same length leading to the common exhaust passage thereon to the discharge.

Figure 17:
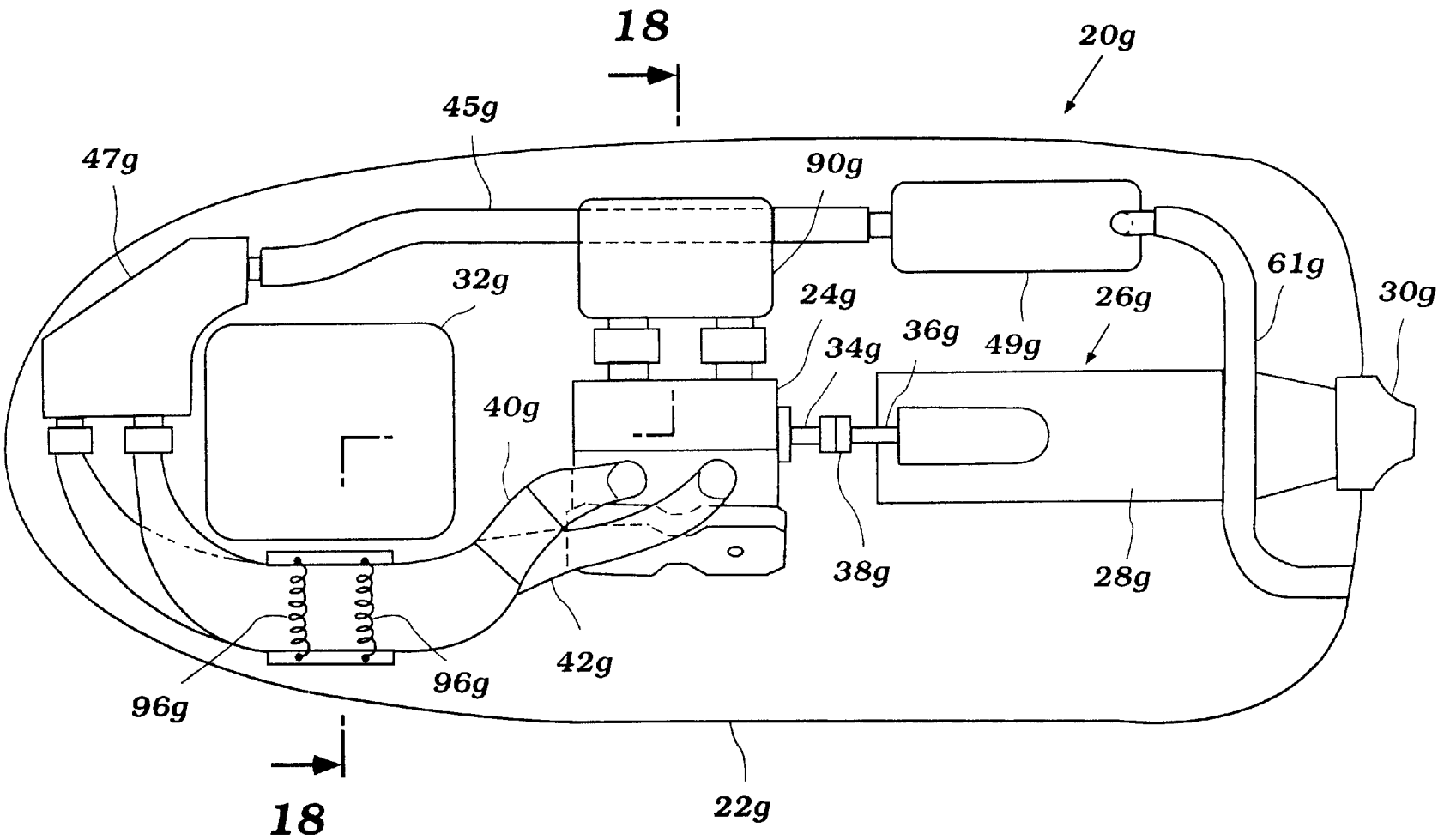
FIG. 17 is a top cross-sectional view of a watercraft powered by an engine and having an exhaust system in accordance with an eighth embodiment of the present invention.
Figure 18:
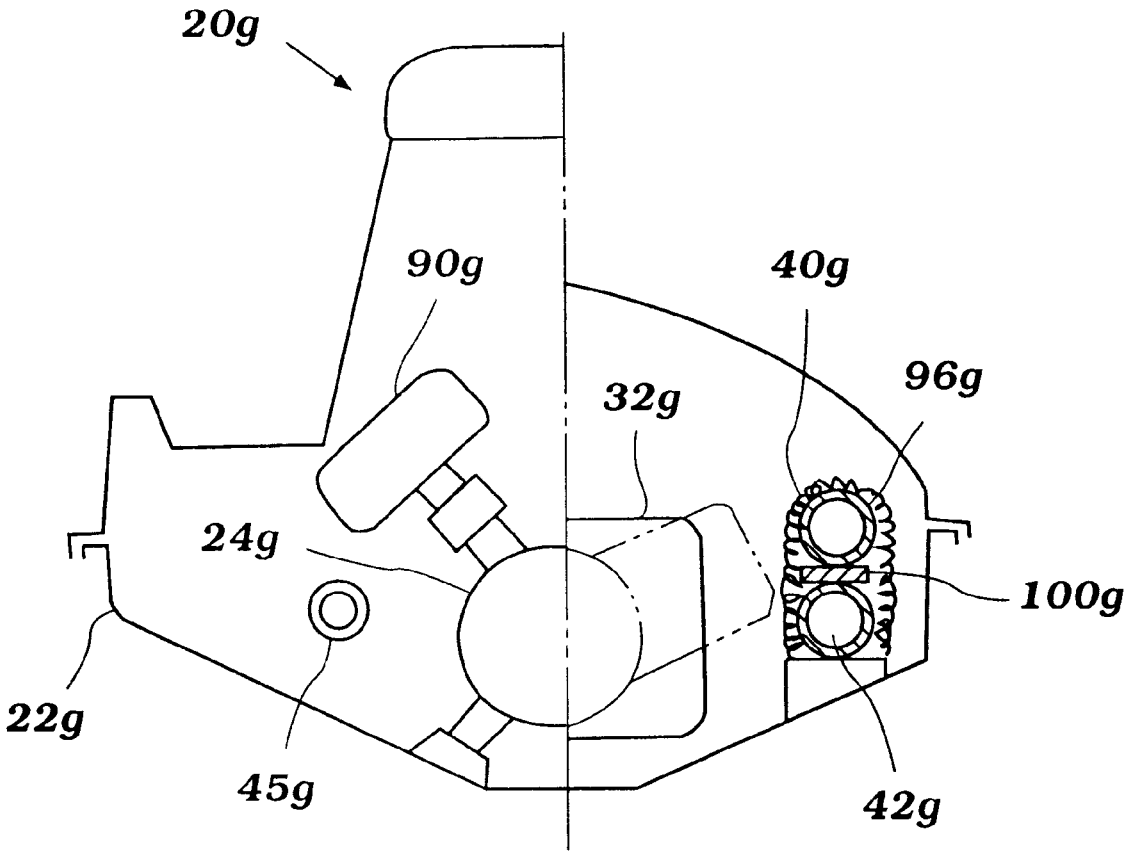
FIG. 18 is a cross-sectional view of the watercraft and exhaust system illustrated in FIG. 17 and taken in the direction of line 18—18 therein.

FIGS. 17 and 18 illustrate a watercraft 20*g* powered by an engine 24*g* and having an exhaust system in accordance with an eighth embodiment of the present invention. In the illustration and description of this embodiment, like reference numerals have been used with similar parts to those of the prior embodiments, except that a "g" designator has been added to all reference numerals of this embodiment.

In this embodiment, the engine 24*g* is oriented similar to that illustrated and described in conjunction with FIGS. 11–16, in that the engine 24*g* is tilted to one side of vertical. First and second exhaust pipes 40*g*,42*g* extend outwardly from the engine 24*g* and extend towards the front end of the watercraft 20*g* to a first water lock 47*g* positioned generally forward of a fuel tank 32*g* in front of the engine 24*g*.

These exhaust pipes 40*g*,42*g* are resiliently connected to the watercraft 20*g* between their connection to the engine 24*g* and the waterlock 47*g*. As best illustrated in FIG. 18, the exhaust pipes 40*g*,42*g* are generally vertically arranged at the location adjacent the side of the fuel tank 32*g*. At this location the bottom exhaust pipe 42*g* is supported by the bottom of the hull 22*g* of the watercraft 20*g*, and a support platform 100*g* extends between the bottom exhaust pipe 42*g* and the top exhaust pipe 40*g* for supporting the top exhaust pipe 40*g*. Springs 96*g* or similar members preferably extend at least partially around the exhaust pipes 40*g*,42*g*, resiliently retaining them in position at this support position.

These exhaust pipes 40*g*,42*g* extend around the front end of the fuel tank 32*g* to the waterlock 47*g*, which is preferably positioned at a front corner of the watercraft 20*g* between the hull 22*g* and fuel tank 32*g*. As illustrated, the waterlock 47*g* is shaped to extend around the fuel tank 32*g*, whereby the waterlock 47*g* occupies the space between the hull 22*g* and fuel tank 32*g* without requiring the hull 22*g* be substantially enlarged to accommodate the waterlock 47*g*.

An exhaust pipe 45*g* extends from the waterlock 47*g* along a side of the engine 22*g* opposite the side from which the first and second exhaust pipes 40*g*,42*g* extend. This exhaust pipe 45*g* extends to a secondary waterlock 49*g* positioned near the rear of the watercraft 20*g*. A single discharge exhaust pipe 61*g* extends from this secondary waterlock 49*g* to a discharge. Preferably, the exhaust pipe 61*g* extends from one side of the watercraft 20*g* to the other from the waterlock 49*g* to the discharge.

The exhaust system of this embodiment has the generally similar advantages to those described above, with low exhaust backpressure, dual water locks, and a resilient mounting to prevent vibration shock to the exhaust system. Further, as illustrated in FIG. 18, the stacked arrangement of the exhaust pipes 40*g*,42*g* permits the exhaust system to occupy a small width and then be positioned in the area between the engine 24*g* and the adjacent side of the hull to which the engine 24*g* tilts. In addition, a portion of the exhaust system extends beneath the engine 24*g*. In particular, exhaust pipe 45*g* extends between the overhanging intake 90*g* and the hull 22*g*. This arrangement is such that the exhaust system occupies space which is otherwise unoccupied and thus permits opens up other space in the engine compartment for other components.

Figure 19:
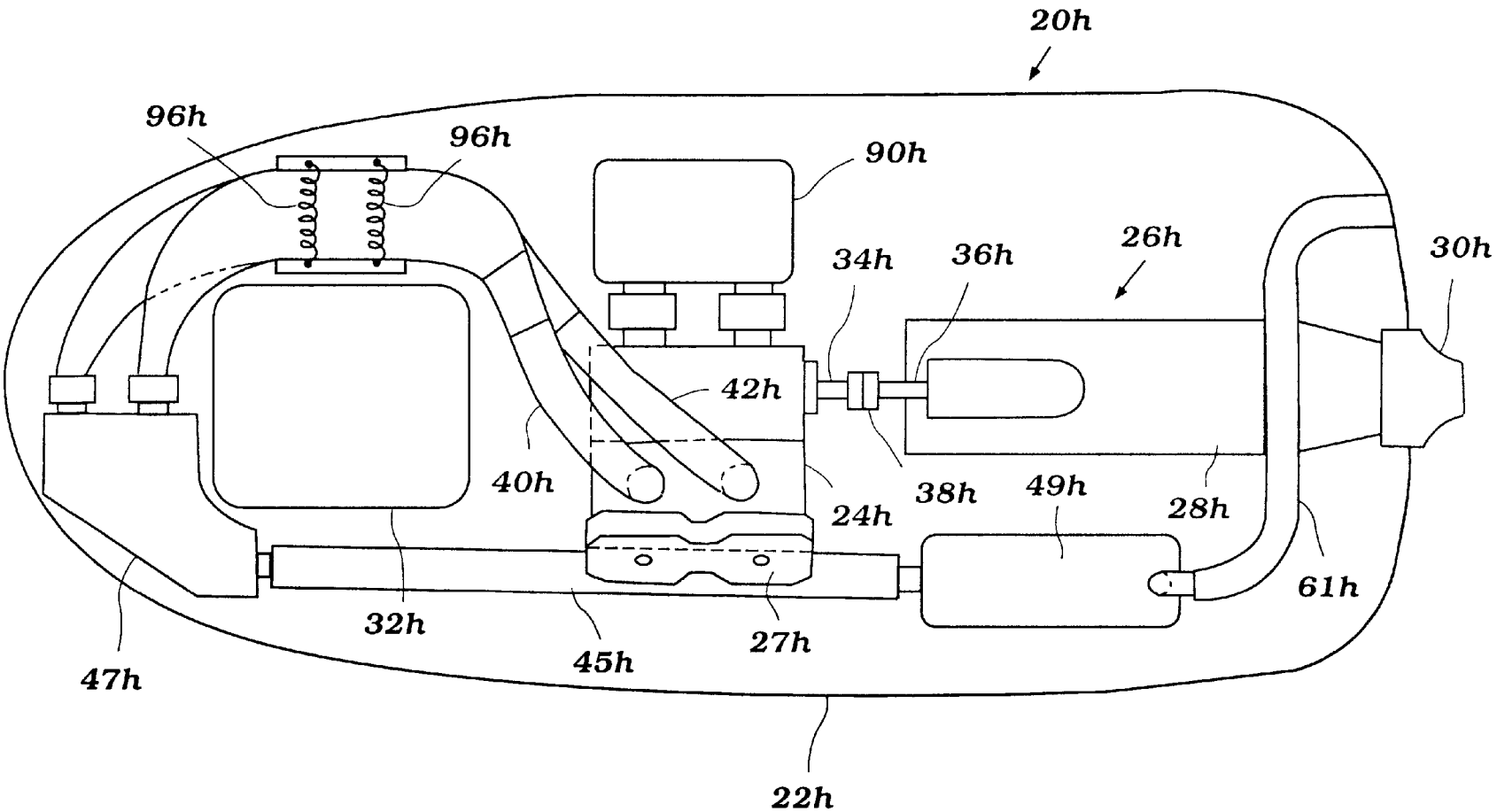
FIG. 19 is a top cross-sectional view of a watercraft powered by an engine and having an exhaust system in accordance with a ninth embodiment of the present invention.

FIG. 19 illustrate a watercraft 20*h* powered by an engine 24*h* and having an exhaust system in accordance with a ninth embodiment of the present invention. In the illustration and description of this embodiment, like reference numerals have been used with similar parts to those of the prior embodiments, except that an "h" designator has been added to all reference numerals of this embodiment.

This embodiment exhaust system is similar to the last illustrated in FIGS. 17 and 18 described above. In this embodiment, however, the first and second exhaust pipes 40*h*,42*h* extend from a first side of the engine 24*h* forwardly and across the top of the engine 24*h* to the opposite side thereof. The first and second exhaust pipes 40*h*,42*h* then extend along the side of the fuel tank 32*h* which corresponds to the side of the engine 24*h* from which the exhaust pipes extend.

The exhaust pipes 40*h*,42*h* extend to a first waterlock 47*h* positioned generally in front of the fuel tank 32*h* (positioned in front of the engine 24*h*). The first waterlock 47*h* is positioned at a corner of the fuel tank 32*h* between the tank and the hull 22*h*.

An exhaust pipe 45*h* extends from the first waterlock 47*h* along that side of the engine 24*h* from which the first and second exhaust pipes 40*h*,42*h* extend. The exhaust pipe 45*h* extends to a secondary waterlock 49*h* positioned near the rear of the watercraft 20*h*. A single exhaust discharge pipe 61*h* extends from the secondary waterlock 49*h* to the opposite side of the watercraft 20*h* to a discharge.

This embodiment exhaust system has similar advantages to those of the embodiment illustrated in FIGS. 17 and 18, including that of having a portion of the exhaust system extend below a part of the engine (in this case the overhanging tilted engine body 27*h*).

Figure 20:
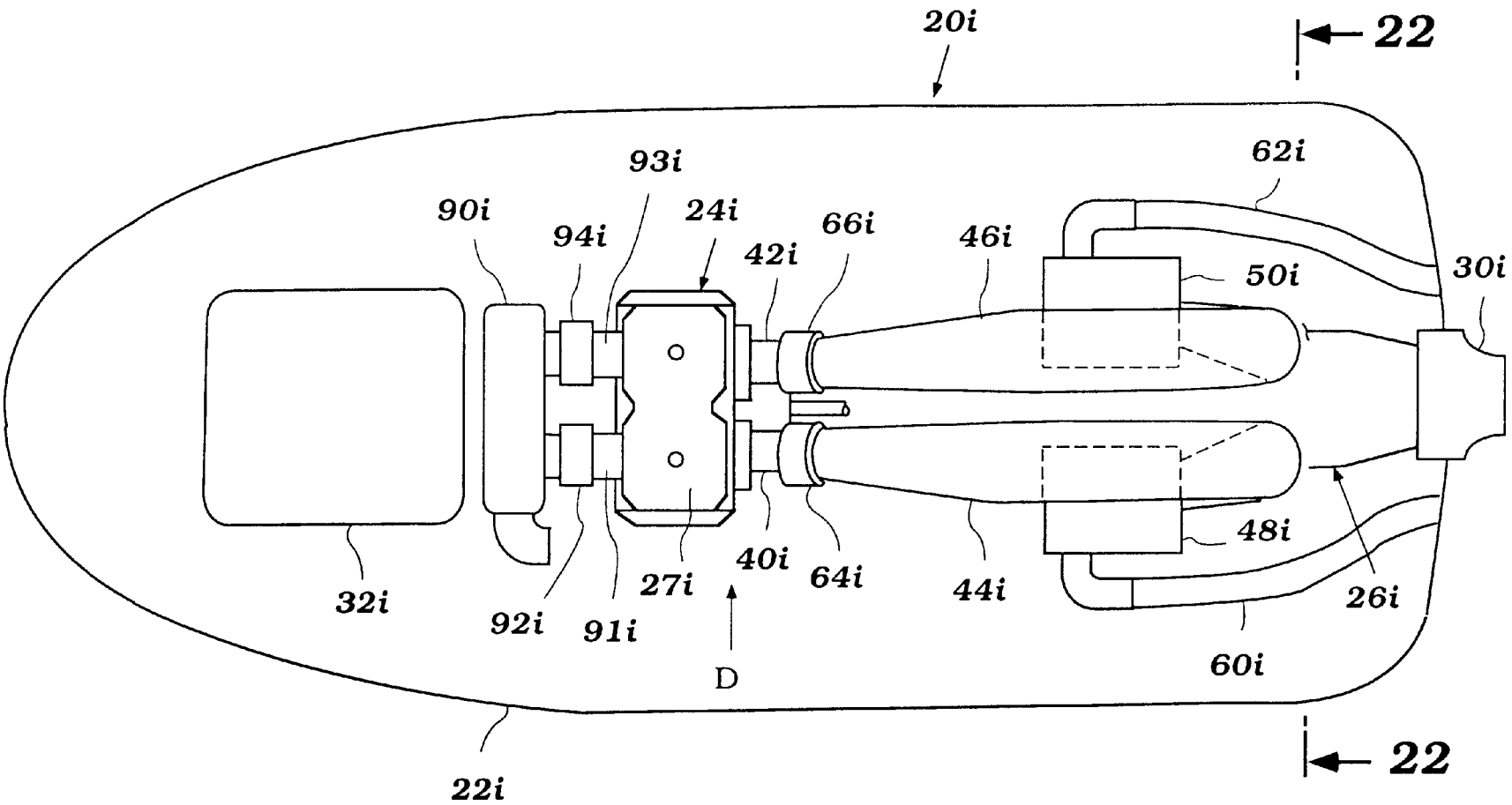
FIG. 20 is a top cross-sectional view of a watercraft powered by an engine and having an exhaust system in accordance with a tenth embodiment of the present invention.
Figure 21:
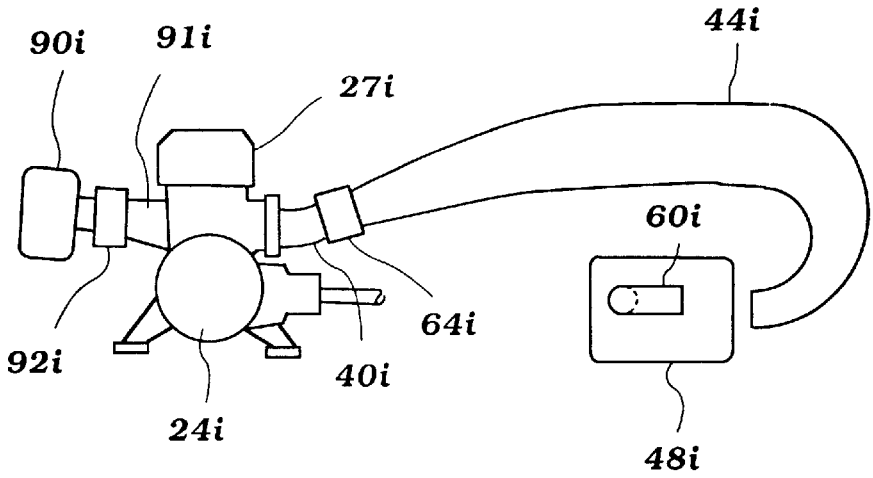
FIG. 21 is a side view of the exhaust system illustrated in FIG. 20 and taken in the direction of arrow D therein.
Figure 22:
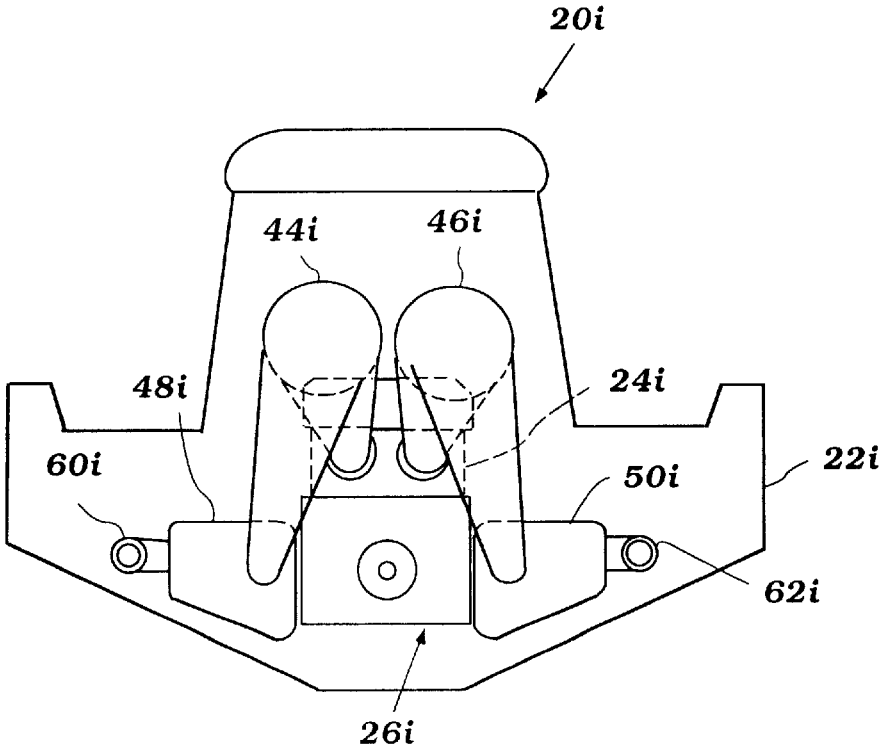
FIG. 22 is a cross-sectional view of the watercraft and exhaust system illustrated in FIG. 20 taken in the direction of line 22—22 therein.

FIGS. 20–22 illustrate a watercraft 20*i* powered by an engine 24*i* and having an exhaust system in accordance with a tenth embodiment of the present invention. In the illustration and description of this embodiment, like reference numerals have been used with similar parts to those of the prior embodiments, except that an "i" designator has been added to all reference numerals of this embodiment.

In accordance with this embodiment, the engine 24*i* is arranged so that its pair of cylinders are aligned along an axis extending transverse to the watercraft 20*i* (i.e. parallel to a line extending through the sides of the watercraft or perpendicular to a line extending through the front and rear of the watercraft). The pistons of each cylinder are arranged to drive a crankshaft which is also transversely extending, but which is arranged to drive a drive shaft which extends out engine towards the rear of the watercraft 20*i* to drive the water propulsion device.

In this arrangement, the intake, including the silencer 90*i* and carburetors 92*i*,94*i* are preferably positioned at a front end of the engine 24*i* just behind a fuel tank 32*i*.

The exhaust passage leading from each cylinder terminate at a rear end of the engine 24*i*. The exhaust system includes a first exhaust pipe 40*i* connected to the engine 24*i* and having a passage therethrough aligned with the exhaust passage corresponding to one of the cylinders. A second exhaust pipe 42*i* is similarly provided for the exhaust passage corresponding to the other cylinder. The exhaust pipes 40*i*,42*i* extend rearwardly from the engine 24*i* to a corresponding muffler 44*i*,46*i*. Preferably, each exhaust pipe 40*i*,42*i* is coupled to its respective muffler 44*i*,46*i* with a flexible coupling 64*i*,66*i*, such as a rubber hose.

The mufflers 44*i*,46*i* extend in a generally straight line towards the rear of the engine 24*i* to a respective water lock 48*i*,50*i*. As illustrated, each muffler 44*i*,46*i*connects to a rear portion of its respective water lock 48*i*,50*i*.

An exhaust discharge pipe 60*i*,62*i* extends from the water lock 60*i*,62*i* through the hull 22*i* of the watercraft 20*i* at its rear end where the exhaust gas is discharged into the water. As illustrated, these discharge pipes 60*i*,62*i* extend from an outer side (i.e. a side facing towards the closest outer side of the watercraft hull) of its respective water lock 60*i*,62*i*.

The exhaust system of this embodiment of the invention has advantages similar to those of the prior embodiments, including the fact that the exhaust flow path is generally straight and unrestricted. In addition, the exhaust flow path corresponding to each cylinder is generally of the same length. Engine vibration is effectively isolated from the mufflers 44*i*,46*i*by the resilient or flexible couplings 64*i*,66*i*.

Figure 23:
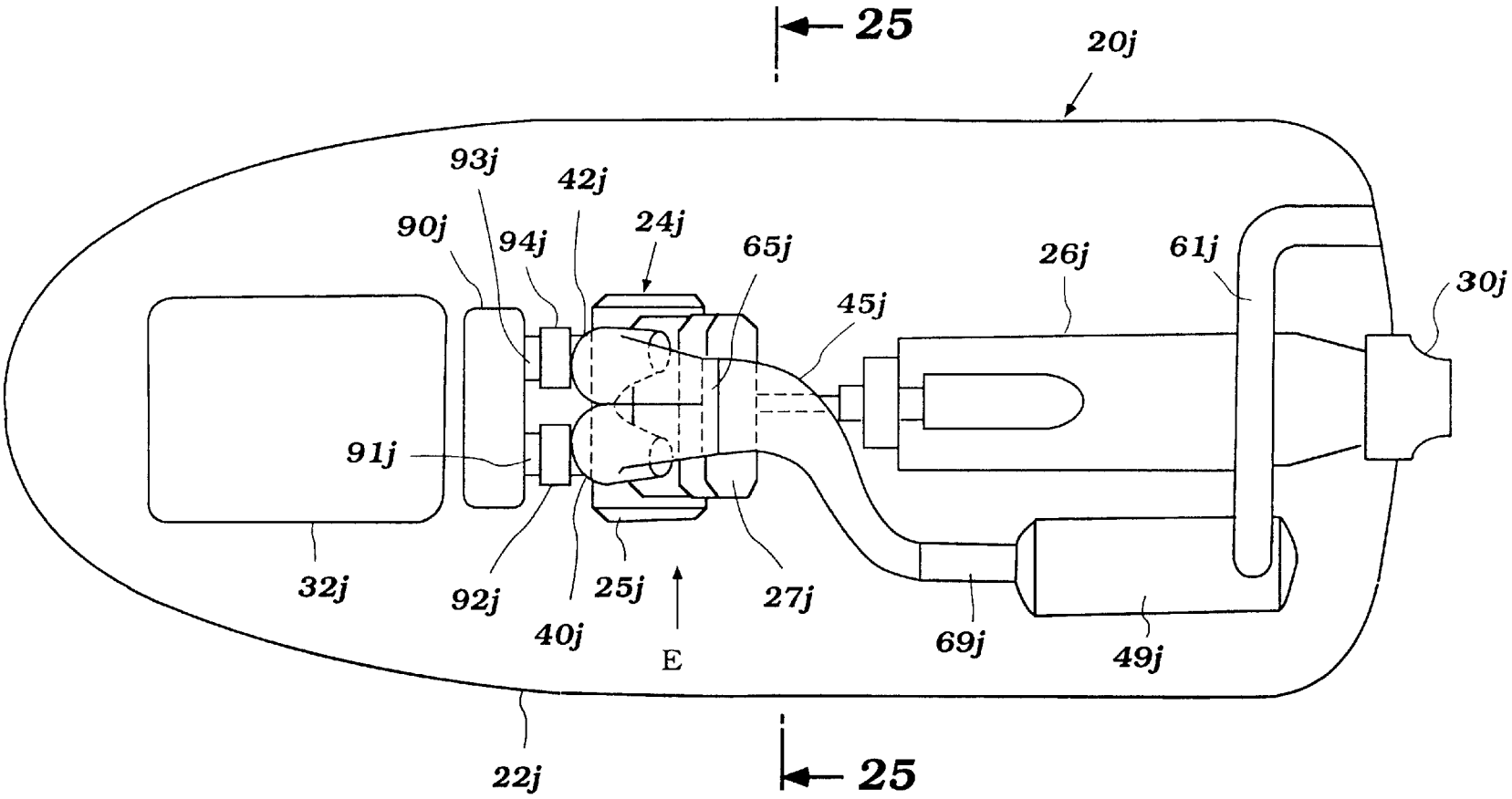
FIG. 23 is a top cross-sectional view of a watercraft powered by an engine and having an exhaust system in accordance with an eleventh embodiment of the present invention.
Figure 24:
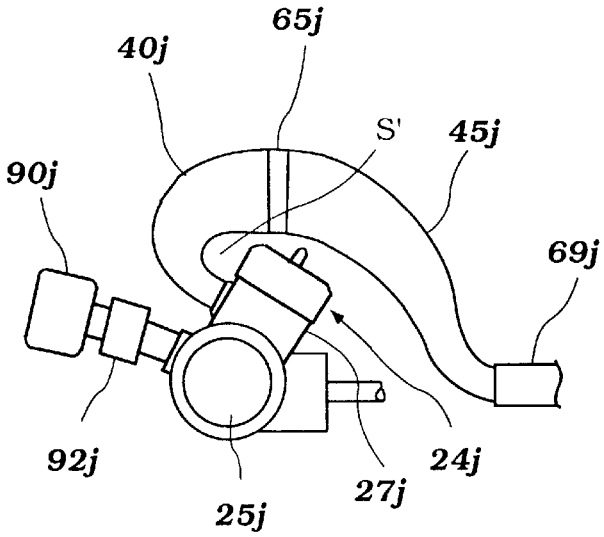
FIG. 24 is a side view of the exhaust system illustrated in FIG. 23 and taken in the direction of arrow E therein.
Figure 25:
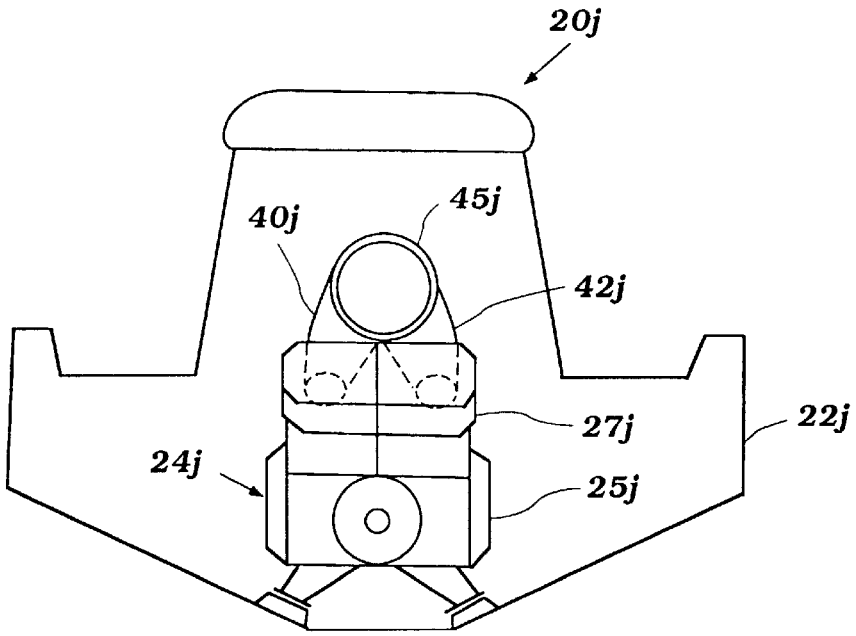
FIG. 25 is a cross-sectional view of the watercraft and exhaust system illustrated in FIG. 23 taken in the direction of line 25—25 therein.

FIGS. 23–25 illustrate a watercraft 20*j* powered by an engine 24*j* and having an exhaust system in accordance with an eleventh embodiment of the present invention. In the illustration and description of this embodiment, like reference numerals have been used with similar parts to those of the prior embodiments, except that a "j" designator has been added to all reference numerals of this embodiment.

This embodiment is similar to that illustrated in FIGS. 20–22. In this embodiment, however, the cylinders of the engine 24*j* are tilted towards a rear of the watercraft 20*j* from a crankcase 25*j*. In this arrangement, the air intake is again positioned at a front of the engine 24*j*. In this orientation, a space S' is defined above the engine 24*j* between that portion defining the cylinders and the air intake system.

The exhaust system again includes first and second exhaust pipes 40*j*,42*j* corresponding to the exhaust passages of the pair of cylinders of the engine 24*j*. In this embodiment, however, the exhaust passages extend through a portion of the engine defining the cylinders which faces towards the front (versus the rear, as in the embodiment illustrated in FIG. 21) of the watercraft 24*j*.

The exhaust pipes 40*j*,42*j* extend from the engine 24*j* towards the front of the watercraft 24*j* into the space S' and then curve up and back around the top of the engine to a single muffler or expansion pipe 45*j*. Preferably, the exhaust pipes 40*j*,42*j* are both connected to the muffler 45*j* through a flexible coupling 65*j* such as a rubber hose.

The muffler 45*j* extends beyond the rear end of the engine 24*j* towards the rear of the watercraft 24*j* to a water lock 49*j*. Preferably, the muffler 45*j* is connected to the water lock 49*j* through a flexible coupling 69*j* such as a rubber hose. A single exhaust gas discharge pipe 61*j* extends from the water lock 49*j* through the hull 22*j* to discharge the exhaust gas into the water.

This arrangement has generally the same advantages of the those of the prior embodiment, including an unrestricted exhaust gas flow, compact exhaust arrangement, equal exhaust flow path for each cylinder, and a vibration insulating muffler mounting.

Figure 26:
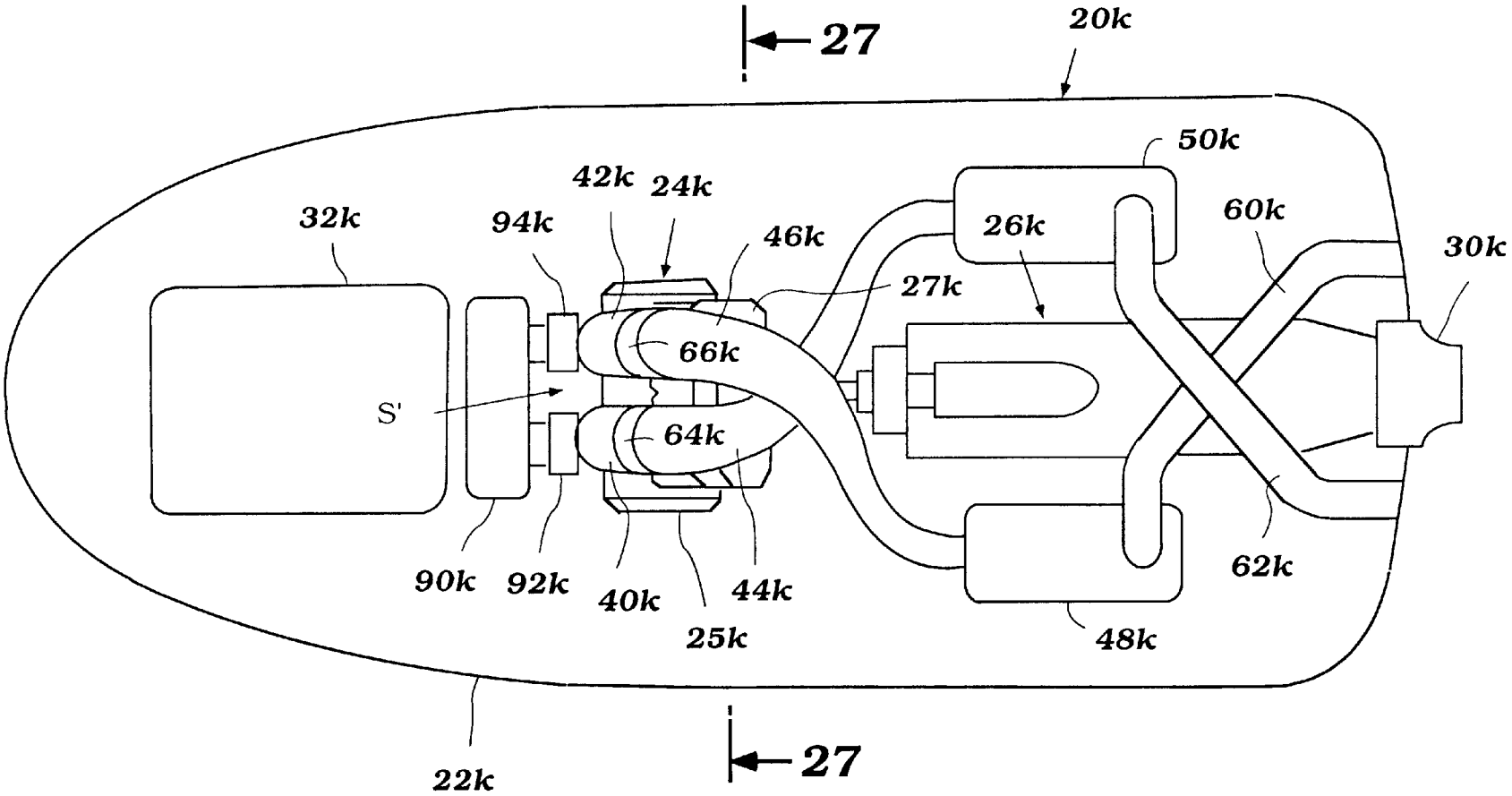
FIG. 26 is a top cross-sectional view of a watercraft powered by an engine and having an exhaust system in accordance with a twelfth embodiment of the present invention.
Figure 27:
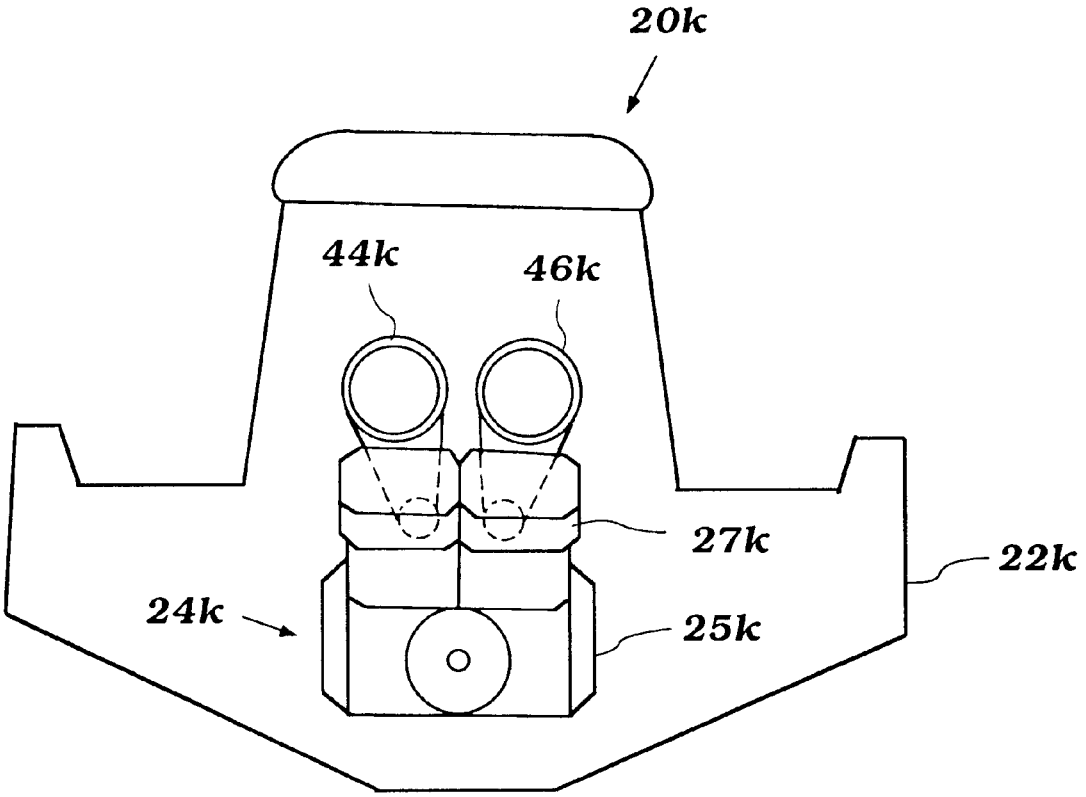
FIG. 27 is a cross-sectional view of the watercraft and exhaust system illustrated in FIG. 26 taken in the direction of line 27—27 therein.

FIGS. 26–27 illustrate a watercraft 20*k* powered by an engine 24*k* and having an exhaust system in accordance with a twelfth embodiment of the present invention. In the illustration and description of this embodiment, like reference numerals have been used with similar parts to those of the prior embodiments, except that a "k" designator has been added to all reference numerals of this embodiment.

In this embodiment, the engine 24*k* is generally arranged as described and illustrated in the prior embodiment (FIGS. 23–25). The first and second exhaust pipes 40*k*,42*k* again extend outwardly from the engine 24*k* towards the front end of the watercraft 20*k* before bending upwardly over the top of the engine 24*k* to a respective muffler 44*k*,46*k*. Preferably, the exhaust pipes 40*k*,42*k* are again connected to a respective muffler 44*k*,46*k* with a flexible coupling 64*k*,66*k*, such as a rubber hose or fitting.

As illustrated, the mufflers 44*k*,46*k* are generally elongate and extend towards the rear end of the watercraft 20*k*. The mufflers 44*k*,46*k* cross behind the engine 24*k* and lead to a water lock 48*k*,50*k*. An exhaust discharge pipe 60*k*,62*k* extends from each water lock 48*k*,50*k*, the pipes 60*k*,62*k* crossing before the extend through the hull 22*k* at the rear of the watercraft 20*k* on each side of the water propulsion device 28*k*.

This exhaust system has the advantages of those embodiments described above. This embodiment has the further advantage of providing a long exhaust path in a compact arrangement and with a generally unrestricted flow path.

Figure 28:
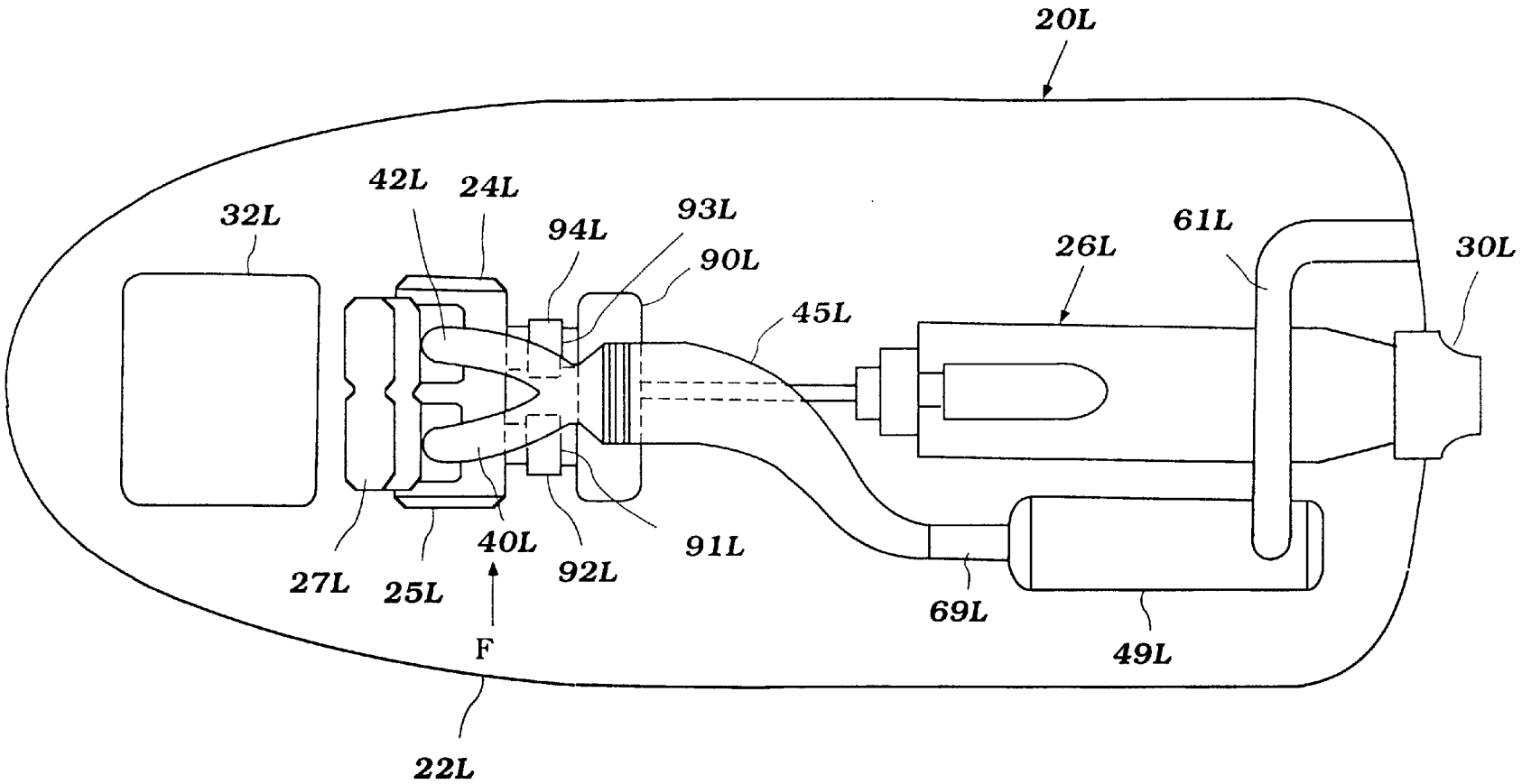
FIG. 28 is a top cross-sectional view of a watercraft powered by an engine and having an exhaust system in accordance with a thirteenth embodiment of the present invention.
Figure 29:
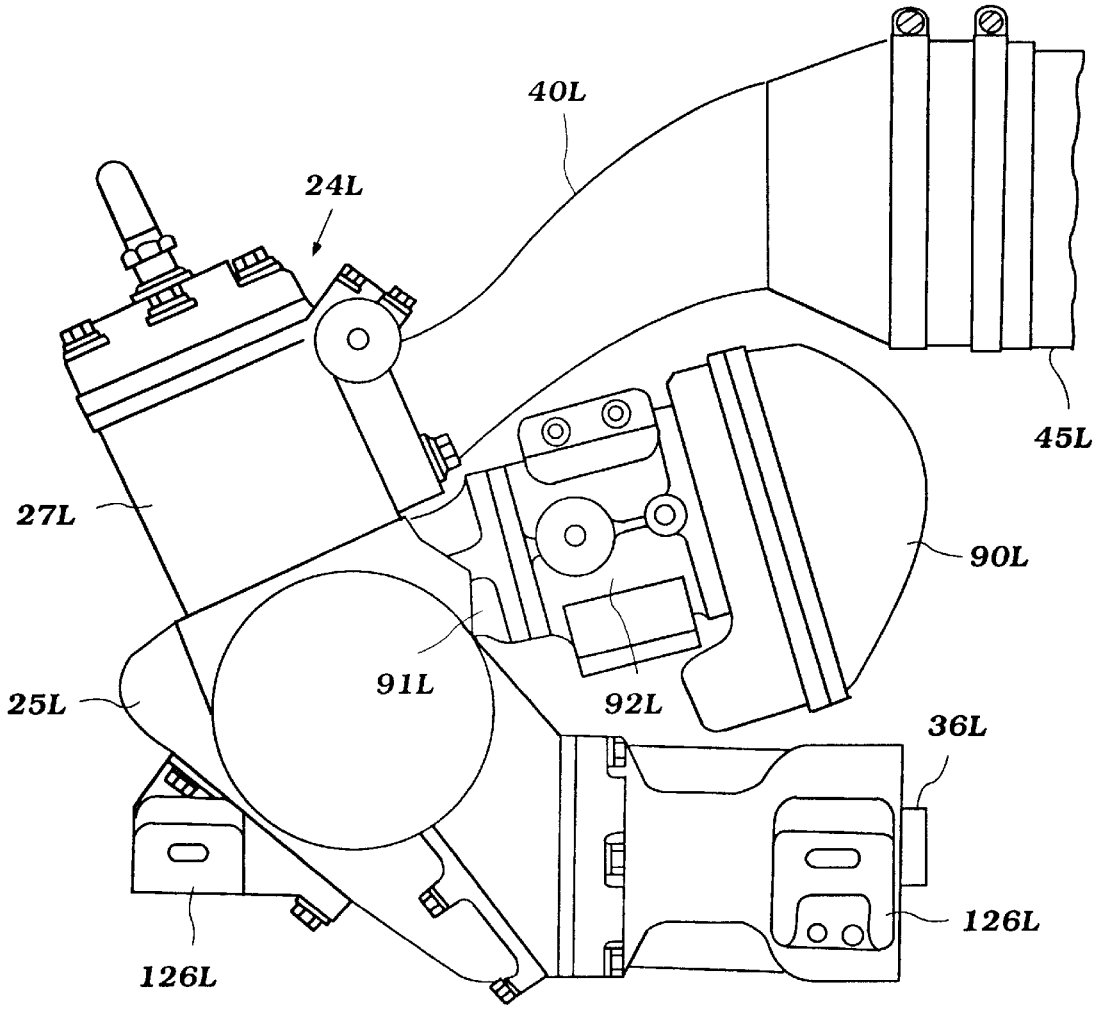
FIG. 29 is a side view of the exhaust system illustrated in FIG. 28 and taken in the direction of arrow F therein.
Figure 30:
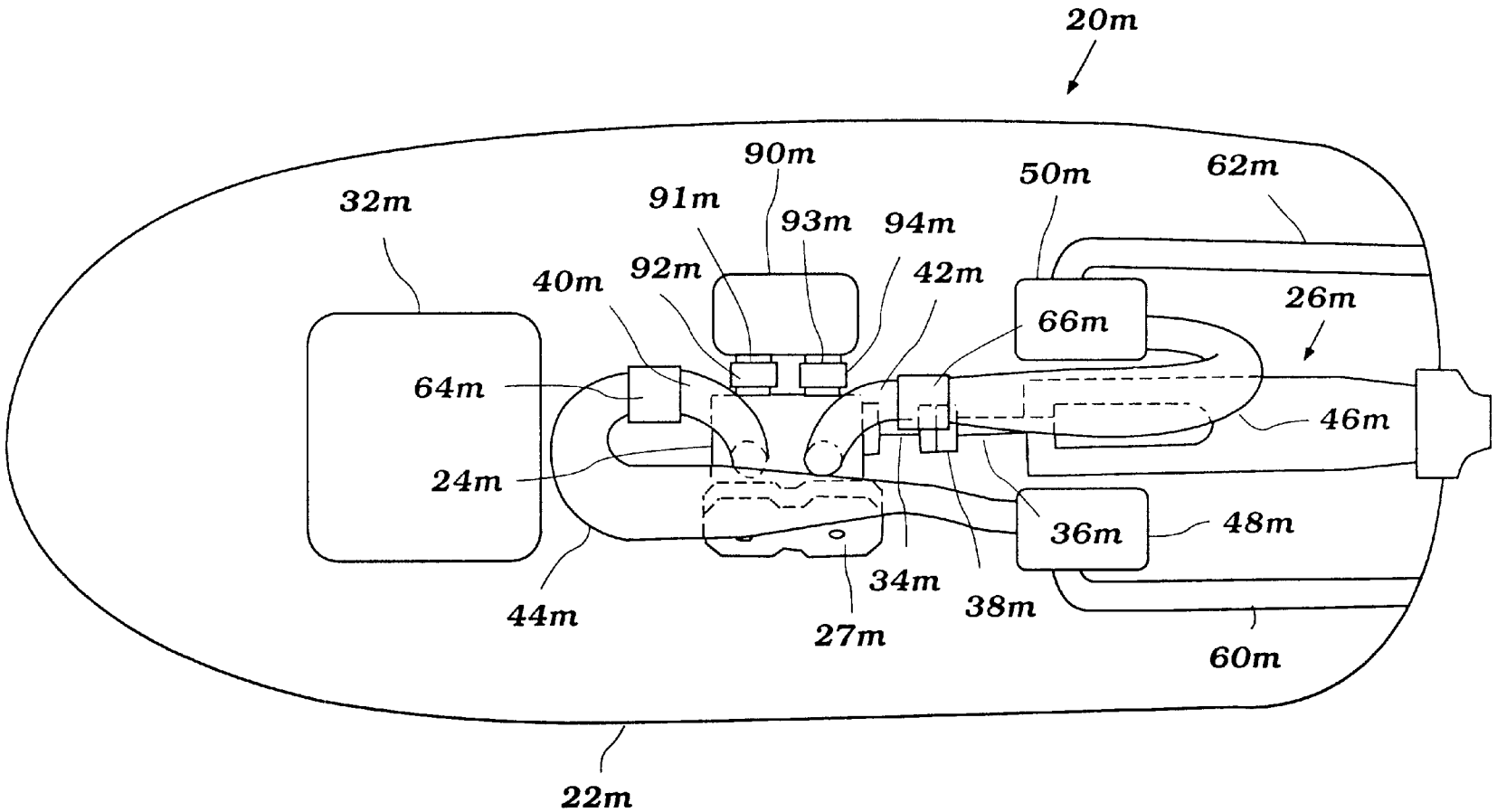
FIG. 30 is a top cross-sectional view of a watercraft powered by an engine and having an exhaust system in accordance with a fourteenth embodiment of the present invention.
Figure 31:
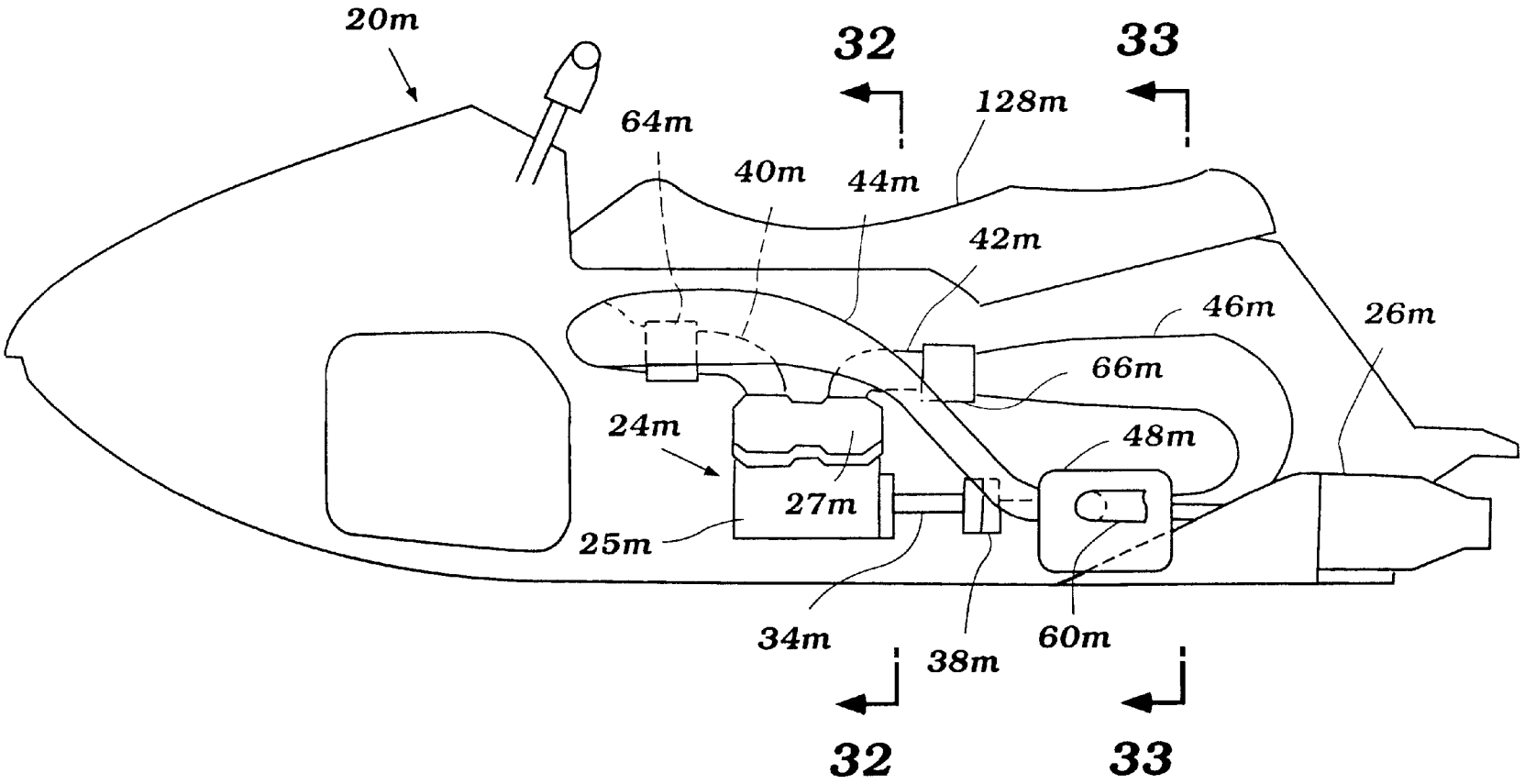
FIG. 31 is a cross-sectional side view of the watercraft illustrated in FIG. 30.
Figure 32:
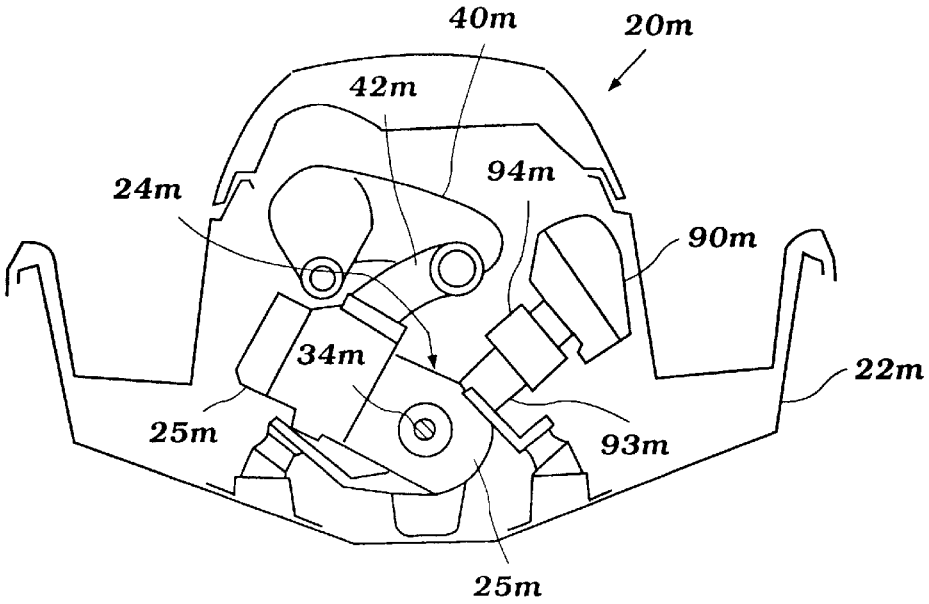
FIG. 32 is a cross-sectional view of the watercraft and exhaust system illustrated in FIG. 31 and taken in the direction of line 32—32 therein.

FIGS. 28–29 illustrate a watercraft 20L powered by an engine 24L and having an exhaust system in accordance with a thirteenth embodiment of the present invention. In the illustration and description of this embodiment, like reference numerals have been used with similar parts to those of the prior embodiments, except that an "L" designator has been added to all reference numerals of this embodiment.

In this embodiment, the cylinder of the engine 24L are again arranged in transverse fashion and is connected to the hull with several engine mounts 126L. The intake system is positioned at a rear end of the engine 24L and provides an air and fuel charge into the crankcase chamber 25L.

As best illustrated in FIG. 29 the exhaust passage corresponding to each cylinder extends through the engine 24L to its rear side. First and second exhaust pipes 40L,42L are connected to the engine 24L and have passages aligned with the exhaust passages leading from the cylinders. As illustrated, these exhaust pipes 40L,42L extend towards the rear of the watercraft 20L, merging into a single pipe portion connected to a single muffler 45L.

The muffler 45L further extends towards the rear of the watercraft 20L to a water lock 49L. The muffler 45L is preferably connected to the water lock 49L with a flexible coupling 69L, such as a rubber hose. A single exhaust discharge pipe 61L extends from the water lock 49L through the hull 22L of the watercraft 20L at its rear end.

This embodiment exhaust system has generally the same benefits as those described above. This arrangement has the particular benefit that the exhaust system flow path provides for unrestricted flow.

FIGS. 30–33 illustrate a watercraft 20*m* powered by an engine 24*m* and having an exhaust system in accordance with a fourteenth embodiment of the present invention. In the illustration and description of this embodiment, like reference numerals have been used with similar parts to those of the prior embodiments, except that an "m" designator has been added to all reference numerals of this embodiment.

In this embodiment, the engine 24*m* is arranged similar to that illustrated in FIG. 14, with the cylinders arranged along a line extending from the front to the rear of the watercraft 20*m*.

The exhaust pipe 42*m* corresponding to the rear-most cylinder preferably extends from the engine 24*m* towards the stem or rear of the watercraft, connecting to a muffler 46*m* or expansion pipe through a flexible coupling 66*m*. This muffler 46*m* leads to a waterlock 50*m* positioned along one side of the propulsion unit 26*m*. A single discharge exhaust pipe 62*m* extends in generally a straight line from the waterlock 50*m* to a discharge.

The exhaust pipe 40*m* corresponding to the front-most cylinder preferably extends from the engine 24*m* forwardly to the muffler 44*m*. The muffler 44*m* extends from a point generally in front of the engine 24*m* towards the rear of the watercraft 20*m* over the body 27*m* of the engine 24*m* and to the side opposite the other muffler 46*m* from the intake silencer 90*m*.

This muffler 44*m* extends to a waterlock 48*m* positioned on the opposite side of the propulsion unit 26*m* from the first waterlock 50*m*. A generally straight discharge exhaust pipe 60*m* extends from the waterlock 50*m* to a discharge at the stem of the watercraft 20*m*.

Figure 33:
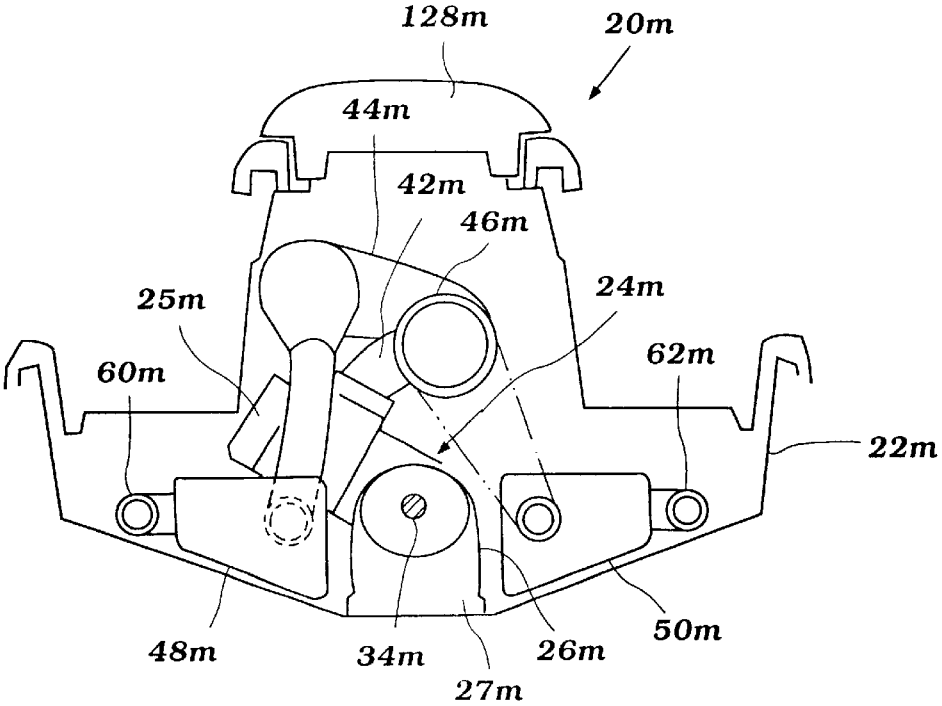
FIG. 33 is a cross-sectional view of the watercraft and exhaust system illustrated in FIG. 31 and taken in the direction of line 33—33 therein.

As illustrated in FIG. 33, this arrangement permits the exhaust system to extend with small bends because it occupies the tall space within the engine compartment defined beneath a seat 128*m* (a step portion on each side of the seat 128*m* reduces the height of the engine compartment in the area therebelow).

In this embodiment, the portion of the exhaust system corresponding to the forward-most cylinder extends towards the front of the watercraft 20*m* before bending rearwardly, while the portion of the exhaust system corresponding to the rear-most cylinder extends generally directly rearwardly.

Figure 34:
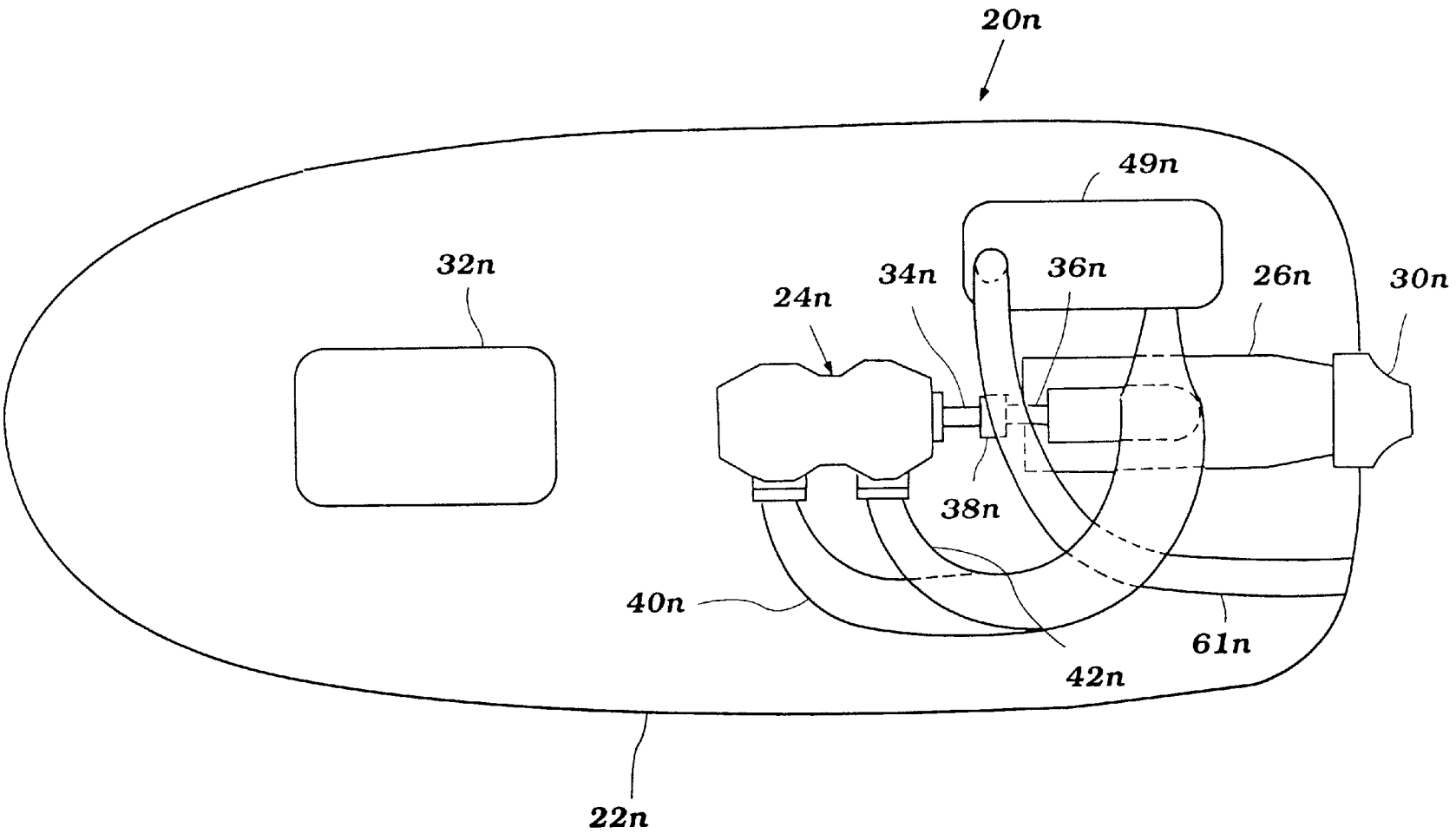
FIG. 34 is a top cross-sectional view of a watercraft powered by an engine and having an exhaust system in accordance with a fifteenth embodiment of the present invention.

FIG. 34 illustrate a watercraft 20*n* powered by an engine 24*n* and having an exhaust system in accordance with a fifteenth embodiment of the present invention. In the illustration and description of this embodiment, like reference numerals have been used with similar parts to those of the prior embodiments, except that an "n" designator has been added to all reference numerals of this embodiment.

In this embodiment, the engine 24*d* has its cylinders extending vertically (i.e. the engine does not tilt). In this arrangement, each exhaust pipe 40*n*,42*n* extend generally perpendicularly outwardly from one side of the engine 24*n*. These exhaust pipes 40*n*,42*n* then bend rearwardly and extend across to the opposite side of the watercraft 20*n* to a waterlock 49*n* positioned near the stem of the craft. A single exhaust discharge pipe 61*n* extends from the waterlock 49*n* to an in the water discharge.

As illustrated, the exhaust pipes 40*n*,42*n* extend to a rear portion of the waterlock 49*n* to minimize the bend therein, and the single exhaust discharge pipe 61*n* extends from the front of the waterlock 49*n* for the same reason.

The exhaust system of this embodiment has the advantage that it has reduced exhaust backpressure along with a compact arrangement.

In all embodiments of the present invention, the particular connections of the various portions of the exhaust system may be arranged as known to those skilled in the art. For example, the exhaust pipes may be connected to the engine with mounting bolts or similar fasteners. The flexible coupling members may be connected to the various parts of the exhaust system with adjustable metal bands or similar fittings.

The particular materials and construction of portions of the exhaust systems described above may also be of types well known to those skilled in the art. For example, the exhaust pipes may be made of steel or the like, and the flexible coupling members may comprise rubber, flexible metal members or the like.

The term "muffler" as used above generally is meant to mean a section of the exhaust system in which the exhaust sound is reduced. This may be accomplished by a baffle-type muffler. In addition, the muffler may simply comprise an expansion chamber (i.e. a section of the exhaust system having an enlarged flow path) as known to those of skill in the art.

Of course, the foregoing description is that of preferred embodiments of the invention, and various changes and modifications may be made without departing from the spirit and scope of the invention, as defined by the appended claims.

What is claimed is:

1. A watercraft and exhaust system for an engine powering a water propulsion device of said watercraft, said watercraft having a hull with a front end and a rear end, said water propulsion device positioned near said rear end of said watercraft, said engine supported by said hull and positioned generally towards a front end of said watercraft from said water propulsion device and having an output shaft arranged to drive said water propulsion device, said engine having a body defining at least two in line cylinders, a first of said cylinders positioned towards an end of said body towards said front end of said watercraft and a second of said cylinders positioned towards an end of said body towards said rear end of said watercraft, said engine having an exhaust system defining an exhaust flow path from each of said cylinders to an atmospheric discharge through said hull at said rear of said watercraft, first portions of said exhaust system extending independently from each of said first and said second cylinders extending within said hull towards said front end of said watercraft forwardly of said engine and a second portion of said exhaust system communicating with said first portions extending rearward within said hull to the atmospheric discharge.

2. The watercraft and exhaust system in accordance with claim 1, wherein said exhaust system first portions include a first exhaust pipe connected to said engine and having a passage therethrough for routing exhaust from said first cylinder to a first muffler and a second exhaust pipe connected to said engine and having a passage therethrough for routing exhaust from said second cylinder to a second muffler.

3. The watercraft and exhaust system in accordance with claim 2, wherein said first exhaust pipe and first muffler are connected with a flexible coupling and said second exhaust pipe and second muffler are connected with a flexible coupling.

4. The watercraft and exhaust system in accordance with claim 1, wherein at least a portion of said first and second part of said exhaust system are resiliently mounted to said hull.

5. The watercraft and exhaust system in accordance with claim 1, wherein said exhaust routed through said first and second portions of said exhaust system passes through at least one water lock.

6. The watercraft and exhaust system in accordance with claim 1, wherein each cylinder has an axis offset from vertical and said engine has an intake system extending from said body and cooperating with said body to define a space above said engine between said body and said intake and wherein at least a portion of said exhaust system extends through said space.

7. The watercraft and exhaust system in accordance with claim 1, wherein there is a common atmospheric discharge for said first and second cylinders.

8. The watercraft and exhaust system in accordance with claim 1, wherein there is a separate atmospheric discharge for each of said first and second cylinders.

9. The watercraft and exhaust system in accordance with claim 5, wherein the first portions of the exhaust system communicate with a common water lock from which the second portion extends.

10. The watercraft and exhaust system in accordance with claim 5, wherein the first portions of the exhaust system communicate with first and second water locks from which the second portion extends.

11. A watercraft and exhaust system for a internal combustion engine powering said watercraft, said watercraft having a hull having a front end and a rear end and a water propulsion device, said engine connected to said hull and having an output shaft arranged to drive said water propulsion device, said engine having a body defining at least two cylinders, said cylinders having their axes lying in a common plane lying at an acute angle to a vertical plane and on one side thereof, an intake system extending from said body of said engine at an angle on the opposite side of said vertical plane from said common plane of said axes of said cylinders, said engine having an exhaust system for routing exhaust from each of said cylinders forwardly within said hull from said engine and then rearwardly to a discharge through said hull contiguous to said propulsion device, said exhaust system including at least one exhaust pipe extending under a portion of said engine between said engine and a bottom of said hull and through which the exhaust passes pass in a rearward direction relative to said watercraft.

12. The watercraft and exhaust system in accordance with claim 2, wherein said portion of said engine comprises said body.

13. The watercraft and exhaust system in accordance with claim 1, wherein said portion of said engine comprises said intake system.

14. A watercraft and exhaust system for a internal combustion engine powering said watercraft, said watercraft having a hull having a front end and a rear end and a water propulsion device, said engine connected to said hull and having an output shaft arranged to drive said water propulsion device, said engine having a body defining at least two cylinders, all of said cylinders of said engine having their axes parallel to each other and lying in a common plane offset from a vertical plane containing a rotational axis of said engine output shaft and on one side thereof, an intake system extending from said body of said engine at an angle on an opposite side of said vertical plane from said axes of said cylinders, said engine having an exhaust system for routing exhaust from each of said cylinders to a discharge, said exhaust system including at least one first exhaust pipe extends from said engine for routing exhaust from at least one of said cylinders, said at least one first exhaust pipe extending towards said front end of said watercraft and communicating with a second exhaust pipe extending in the direction from said front end of said watercraft to said rear end, a portion of said second exhaust pipe extending under a portion of said engine.

15. The watercraft and exhaust system in accordance with claim 14, wherein said portion of said engine comprises said body.

16. The watercraft and exhaust system in accordance with claim 14 wherein said portion of said engine comprises said intake system.

17. A watercraft and exhaust system for a internal combustion engine powering said watercraft, said watercraft having a hull having a front end and a rear end and a water propulsion device, said engine connected to said hull and having an output shaft arranged to drive said water propulsion device, said engine having a body defining at least two cylinders, said cylinders having an axis offset from a vertical plane and on one side thereof, an intake system extending from said body of said engine at an angle on an opposite side of said vertical plane from said axes of said cylinders, said engine having an exhaust system for routing exhaust from each of said cylinders to a discharge, said exhaust system comprising a first exhaust pipe and a second exhaust pipe and at least a portion of said first exhaust pipe extends along and vertically above a portion of said second exhaust pipe.

18. The watercraft and exhaust system in accordance with claim 11, wherein said at least one exhaust pipe is resiliently coupled to said hull.

19. A watercraft and exhaust system in accordance with claim 1 wherein said engine has a fuel supply system including a fuel tank positioned towards said front end of said watercraft from said engine and generally at an end of said engine opposite said water propulsion device, said first portions of said exhaust system defining first exhaust flow paths leading towards said front end of said watercraft along respective one sides of said fuel tank and said second portion extending rearwardly along another side of said fuel tank to said atmospheric discharge.

20. The watercraft and exhaust system in accordance with claim 17, wherein said first paths are defined at least in part by respective exhaust pipes connected to said engine.

21. The watercraft and exhaust system in accordance with claim 18, wherein said cylinders are arranged along an axis extending generally parallel to an axis extending through said watercraft from said front end to said rear end.

22. The watercraft and exhaust system in accordance with claim 19, wherein said first exhaust flow paths include at least one water lock positioned therealong and generally forward of said fuel tank.

23. The watercraft and exhaust system in accordance with claim 22, wherein a second waterlock is positioned in said second exhaust system portion.

24. The watercraft and exhaust system in accordance with claim 19, wherein said second portion of said exhaust system defines a pair of second exhaust flow paths that cross near said rear of said watercraft.

25. A watercraft comprised of a hull with a front end and a rear end, a water propulsion device for propelling said hull through a body of water, said water propulsion device positioned at least in part within said hull and near said rear end of said hull, an engine supported by said hull and positioned generally towards a front end of said watercraft from said water propulsion device and having an output shaft arranged to drive said water propulsion device, said engine having a body defining at least two cylinders formed in a common cylinder bank with their respective axes lying in a common plane, a first of said cylinders positioned towards an end of said body towards said front end of said hull and a second of said cylinders positioned towards an end of said body towards said rear end of said hull, said engine having an exhaust system defining an exhaust flow path from each of said cylinders to a discharge at said rear of said watercraft, said exhaust system including a waterlock arrangement positioned forwardly in said hull from said engine body, first and second exhaust conduits extending from said first and said second cylinders respectively to said waterlock arrangement for delivering exhaust gasses thereto, and an exhaust discharge conduit extending from said waterlock arrangement to the atmosphere through said hull at an area contiguous to said water propulsion device.

26. A watercraft in accordance with claim 25 further including first and second mufflers positioned within respective of said first and said second exhaust conduits.

27. A watercraft in accordance with claim 25 wherein said waterlock arrangement comprises a pair of waterlocks each communicating with a respective one of said first and said second exhaust conduits.

28. A watercraft in accordance with claim 27 wherein said exhaust discharge conduit comprises first and second exhaust discharge conduits each communicating with a respective one of said waterlocks.

29. A watercraft in accordance with claim 25 wherein said waterlock arrangement comprises a common waterlocks with which each of said first and said second exhaust conduits communicates.

30. A watercraft in accordance with claim 29 wherein said exhaust discharge conduit comprises a single exhaust discharge conduit communicating with a said waterlock.

* * * * *

UNITED STATES PATENT AND TRADEMARK OFFICE

CERTIFICATE OF CORRECTION

PATENT NO. : 6,183,324 B1
DATED : February 6, 2001
INVENTOR(S) : Masayoshi Nanami It is certified that error appears in the above-identified patent and that said Letters Patent is hereby corrected as shown below:

Column 2,
Line 39, after "considered", insert -- with --.

Column 8,
Line 10, delete "Figure" and insert -- figure --.

Column 9,
Lines 48, 49 and 52, delete "40d,42d" and insert -- 44d,46d --.

Column 10,
Lines 48, 50, 51 and 54, delete "44e" (second occurrence) and insert -- 46e --.

Column 11,
Lines 9, 10 and 12, delete "44e" (second occurrence) and insert -- 46e --.

Column 13,
Line 42, delete "44i,46iconnects" and insert -- 44i, 46i connects --.
Line 56, delete "44i,46iby" and insert -- 44i, 46i by --.

Column 15,
Lines 36 and 53, delete "stem" and insert -- stern --.

Column 16,
Line 12, delete "stem" and insert -- stern --.

UNITED STATES PATENT AND TRADEMARK OFFICE

CERTIFICATE OF CORRECTION

PATENT NO. : 6,183,324 B1
DATED : February 6, 2001
INVENTOR(S) : Masayoshi Nanami It is certified that error appears in the above-identified patent and that said Letters Patent is hereby corrected as shown below:

Column 17, claim 4,
Line 19, delete "portion" and insert -- part --.
Line 20, delete "part" and insert -- portion --.

Column 17, claim 11,
Line 64, delete "passes" and insert -- gasses --.

Signed and Sealed this

Sixteenth Day of April, 2002

*Attest:*

*Attesting Officer*

JAMES E. ROGAN
*Director of the United States Patent and Trademark Office*